US009235177B2

(12) United States Patent
Seshita et al.

(10) Patent No.: US 9,235,177 B2
(45) Date of Patent: Jan. 12, 2016

(54) FIXING DEVICE AND IMAGE FORMING APPARATUS INCORPORATING SAME

(71) Applicants: Takuya Seshita, Kanagawa (JP); Masahiko Satoh, Tokyo (JP); Masaaki Yoshikawa, Tokyo (JP); Hiroshi Yoshinaga, Chiba (JP); Kenji Ishii, Kanagawa (JP); Tadashi Ogawa, Tokyo (JP); Takahiro Imada, Kanagawa (JP); Hiromasa Takagi, Tokyo (JP); Kazuya Saito, Kanagawa (JP); Naoki Iwaya, Tokyo (JP); Toshihiko Shimokawa, Kanagawa (JP); Kensuke Yamaji, Kanagawa (JP); Teppei Kawata, Kanagawa (JP); Takamasa Hase, Shizuoka (JP); Shuutaroh Yuasa, Kanagawa (JP); Takeshi Uchitani, Kanagawa (JP); Arinobu Yoshiura, Kanagawa (JP); Hajime Gotoh, Kanagawa (JP); Akira Suzuki, Tokyo (JP); Ryota Yamashina, Kanagawa (JP); Yasunori Ishigaya, Kanagawa (JP)

(72) Inventors: Takuya Seshita, Kanagawa (JP); Masahiko Satoh, Tokyo (JP); Masaaki Yoshikawa, Tokyo (JP); Hiroshi Yoshinaga, Chiba (JP); Kenji Ishii, Kanagawa (JP); Tadashi Ogawa, Tokyo (JP); Takahiro Imada, Kanagawa (JP); Hiromasa Takagi, Tokyo (JP); Kazuya Saito, Kanagawa (JP); Naoki Iwaya, Tokyo (JP); Toshihiko Shimokawa, Kanagawa (JP); Kensuke Yamaji, Kanagawa (JP); Teppei Kawata, Kanagawa (JP); Takamasa Hase, Shizuoka (JP); Shuutaroh Yuasa, Kanagawa (JP); Takeshi Uchitani, Kanagawa (JP); Arinobu Yoshiura, Kanagawa (JP); Hajime Gotoh, Kanagawa (JP); Akira Suzuki, Tokyo (JP); Ryota Yamashina, Kanagawa (JP); Yasunori Ishigaya, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 31 days.

(21) Appl. No.: 13/731,432

(22) Filed: Dec. 31, 2012

(65) Prior Publication Data

US 2013/0195477 A1 Aug. 1, 2013

(30) Foreign Application Priority Data

Jan. 30, 2012 (JP) ..... 2012-016934
Nov. 15, 2012 (JP) ..... 2012-251372

(51) Int. Cl.
*G03G 15/20* (2006.01)

(52) U.S. Cl.
CPC ..... *G03G 15/2078* (2013.01); *G03G 15/205* (2013.01); *G03G 15/2039* (2013.01); *G03G 15/2053* (2013.01); *G03G 2215/2035* (2013.01)

(58) Field of Classification Search
CPC ..... G03G 15/205; G03G 15/2071; G03G 15/2046; G03G 15/2039; G03G 15/2078
See application file for complete search history.

(56) References Cited

U.S. PATENT DOCUMENTS

| | | | | |
|---|---|---|---|---|
| 5,300,996 | A | 4/1994 | Yokoyama et al. | |
| 5,832,354 | A | 11/1998 | Kouno et al. | |
| RE36,124 | E | 3/1999 | Yokoyama et al. | |
| 5,915,147 | A | 6/1999 | Kouno et al. | |
| 7,106,986 | B2 * | 9/2006 | Nakayama | 399/69 |
| 7,251,426 | B2 * | 7/2007 | Koshida | 399/68 |
| 8,238,770 | B2 * | 8/2012 | Shimizu | 399/33 |
| 2002/0018663 | A1 | 2/2002 | Furukawa et al. | |
| 2002/0067936 | A1 | 6/2002 | Yasui et al. | |
| 2003/0000933 | A1 | 1/2003 | Yoshinaga et al. | |
| 2003/0016963 | A1 | 1/2003 | Yoshinaga et al. | |
| 2003/0206758 | A1 | 11/2003 | Yasui et al. | |
| 2004/0013453 | A1 | 1/2004 | Shinshi et al. | |
| 2004/0190924 | A1 * | 9/2004 | Iwasaki et al. | 399/68 |
| 2004/0247334 | A1 | 12/2004 | Kishi et al. | |
| 2004/0258426 | A1 | 12/2004 | Kishi et al. | |
| 2005/0025539 | A1 | 2/2005 | Yoshinaga | |
| 2005/0074251 | A1 | 4/2005 | Katoh et al. | |
| 2005/0095043 | A1 | 5/2005 | Yoshinaga et al. | |
| 2005/0129432 | A1 | 6/2005 | Sato et al. | |
| 2005/0163543 | A1 | 7/2005 | Satoh et al. | |
| 2006/0051120 | A1 | 3/2006 | Kishi et al. | |
| 2006/0116230 | A1 | 6/2006 | Satoh et al. | |
| 2006/0165429 | A1 | 7/2006 | Satoh et al. | |
| 2006/0165448 | A1 | 7/2006 | Yoshinaga | |
| 2006/0177232 | A1 | 8/2006 | Ehara et al. | |
| 2006/0182460 | A1 | 8/2006 | Kishi et al. | |
| 2006/0285893 | A1 | 12/2006 | Ishii | |
| 2006/0291891 | A1 * | 12/2006 | DeMoor et al. | 399/88 |
| 2007/0014600 | A1 | 1/2007 | Ishii et al. | |
| 2007/0014603 | A1 | 1/2007 | Satoh et al. | |
| 2007/0059011 | A1 | 3/2007 | Seo et al. | |
| 2007/0059071 | A1 | 3/2007 | Shinshi et al. | |
| 2007/0071475 | A1 * | 3/2007 | Blair et al. | 399/68 |

2007/0110464 A1 5/2007 Nakayama et al.
2007/0212089 A1 9/2007 Seo et al.
2007/0280754 A1 12/2007 Ogawa et al.
2007/0292175 A1 12/2007 Shinshi
2008/0044196 A1 2/2008 Seo et al.
2008/0063443 A1 3/2008 Yoshinaga et al.
2008/0175633 A1 7/2008 Shinshi
2008/0219730 A1 9/2008 Shinshi
2008/0253789 A1 10/2008 Yoshinaga et al.
2008/0317532 A1 12/2008 Ehara et al.
2009/0067902 A1 3/2009 Yoshinaga et al.
2009/0123201 A1 5/2009 Ehara et al.
2009/0123202 A1 5/2009 Yoshinaga et al.
2009/0148204 A1 6/2009 Yoshinaga et al.
2009/0169232 A1 7/2009 Kunii et al.
2009/0297199 A1 12/2009 Yamashina et al.
2010/0104298 A1 4/2010 Hachisuka
2011/0058863 A1 3/2011 Shinshi et al.
2011/0064437 A1 3/2011 Yamashina et al.
2011/0085832 A1 4/2011 Hasegawa et al.
2011/0091253 A1 4/2011 Seo et al.
2011/0116848 A1 5/2011 Yamaguchi et al.
2011/0129268 A1 6/2011 Ishii et al.
2011/0170917 A1 7/2011 Yoshikawa et al.
2011/0182634 A1 7/2011 Ishigaya et al.
2011/0182638 A1 7/2011 Ishii et al.
2011/0194869 A1 8/2011 Yoshinaga et al.
2011/0194870 A1 8/2011 Hase et al.
2011/0200368 A1 8/2011 Yamaguchi et al.
2011/0200370 A1 8/2011 Ikebuchi et al.
2011/0206402 A1 8/2011 Yamashina
2011/0206427 A1 8/2011 Iwaya et al.
2011/0217056 A1 9/2011 Yoshinaga et al.
2011/0217057 A1 9/2011 Yoshinaga et al.
2011/0217093 A1 9/2011 Tokuda et al.
2011/0217095 A1 9/2011 Ishii et al.
2011/0222875 A1 9/2011 Imada et al.
2011/0222888 A1 9/2011 Ikebuchi et al.
2011/0222927 A1 9/2011 Yamashina
2011/0222929 A1 9/2011 Fujimoto et al.
2011/0222930 A1 9/2011 Fujimoto et al.
2011/0222931 A1 9/2011 Shinshi et al.
2011/0229161 A1 9/2011 Ueno et al.
2011/0229180 A1 9/2011 Saito
2011/0229181 A1 9/2011 Iwaya et al.
2011/0229200 A1 9/2011 Yamaguchi et al.
2011/0229225 A1 9/2011 Ishii et al.
2011/0229226 A1 9/2011 Tokuda et al.
2011/0229227 A1 9/2011 Yoshikawa et al.
2011/0229228 A1 9/2011 Yoshikawa et al.
2011/0274453 A1 11/2011 Shimokawa et al.
2011/0286758 A1 11/2011 Yoshinaga
2011/0293309 A1 12/2011 Hase
2011/0311284 A1 12/2011 Seo et al.
2012/0045226 A1 2/2012 Hase et al.
2012/0051766 A1 3/2012 Ueno et al.
2012/0051774 A1 3/2012 Ikebuchi et al.
2012/0093531 A1 4/2012 Yuasa et al.
2012/0093551 A1 4/2012 Ogawa et al.
2012/0107005 A1 5/2012 Hase et al.
2012/0114345 A1 5/2012 Fujimoto et al.
2012/0114354 A1 5/2012 Saito et al.
2012/0121303 A1 5/2012 Takagi et al.
2012/0121304 A1 5/2012 Tokuda et al.
2012/0121305 A1 5/2012 Yoshikawa et al.
2012/0141150 A1* 6/2012 Noh ..... 399/33
2012/0148303 A1 6/2012 Yamaguchi et al.
2012/0155935 A1 6/2012 Yoshikawa et al.
2012/0155936 A1 6/2012 Yamaguchi et al.
2012/0177388 A1 7/2012 Imada et al.
2012/0177393 A1 7/2012 Ikebuchi et al.
2012/0177420 A1 7/2012 Shimokawa et al.
2012/0177423 A1 7/2012 Imada et al.
2012/0177424 A1 7/2012 Saito et al.
2012/0207523 A1 8/2012 Ueno et al.
2012/0219312 A1 8/2012 Yuasa et al.
2012/0224878 A1 9/2012 Ikebuchi et al.
2012/0237273 A1 9/2012 Yoshinaga et al.
2013/0114967 A1* 5/2013 Arimoto et al. ..... 399/70
2013/0209115 A1* 8/2013 Hase et al. ..... 399/33

FOREIGN PATENT DOCUMENTS

JP 57178259 * 11/1982
JP 5-088584 4/1993
JP 2005-250326 9/2005
JP 2007-233011 9/2007
JP 2007-334205 12/2007
JP 2008-158482 7/2008
JP 2008-216928 9/2008
JP 2010-102268 5/2010
JP 2010-211093 9/2010

OTHER PUBLICATIONS

U.S. Appl. No. 13/677,597, filed Nov. 15, 2012, Kawata, et al.
U.S. Appl. No. 13/690,882, filed Nov. 30, 2012, Yoshinaga.
U.S. Appl. No. 13/692,389, filed Dec. 3, 2012, Gotoh, et al.
U.S. Appl. No. 13/716,929, filed Dec. 17, 2012, Kawata, et al.
U.S. Appl. No. 13/717,046, filed Dec. 17, 2012, Iwaya, et al.
U.S. Appl. No. 13/557,841, filed Jul. 25, 2012, Toshihiko Shimokawa, et al.
U.S. Appl. No. 13/608,128, filed Sep. 10, 2012, Shuutaroh Yuasa, et al.
U.S. Appl. No. 13/588,594, filed Aug. 17, 2012, Yasunori Ishigaya, et al.

* cited by examiner

*Primary Examiner* — Clayton E Laballe
*Assistant Examiner* — Ruifeng Pu
(74) *Attorney, Agent, or Firm* — Oblon, McClelland, Maier & Neustadt, L.L.P.

(57) ABSTRACT

A fixing device comprises a rotatable fixing member to apply heat to a recording medium bearing an unfixed image thereon, a heat source to heat the fixing member, and a rotatable pressing member pressing against the fixing member forming a nip therebetween. A driving source rotates and drives the fixing member and the pressing member. An overheat safety device has a relay to open and close a power supply path connected to the heat source. A temperature detector is connected to both the relay and the control unit to detect temperature of the fixing member. The overheat safety device turns off the relay and cuts off power supply to the heat source when the fixing member is overheated. The fixing member is allowed to radiate heat and cool down when the temperature detected by the temperature detector is more than a prescribed level.

28 Claims, 13 Drawing Sheets

FIXING DEVICE AND IMAGE FORMING APPARATUS INCORPORATING SAME

CROSS-REFERENCE TO RELATED APPLICATIONS

This patent application is based on and claims priority pursuant to 35 U.S.C. §119 to Japanese Patent Application Nos. 2012-016934, filed on Jan. 30, 2012 and 2012-251372, filed on Nov. 15, 2012 in the Japanese Patent Office, the entire disclosures of which are hereby incorporated by reference herein.

BACKGROUND OF THE INVENTION

1. Field of the Invention

This invention relates to a fixing device and an image forming apparatus incorporating the fixing device.

2. Description of the Related Art

As a fixing device used in various image forming apparatuses, such as a copier, a printer, a facsimile machine, a multifunctional machine, etc., that which employs a thin-walled fixing belt consisting of a metal substrate and an elastic rubber layer or the like is known. The low heat capacity thin-walled fixing belt greatly reduces energy consumed for heating thereof, and a warm-up time (e.g., reload time) can be shortened. A time to first print (i.e., a time period from receiving a printing request to ejecting a sheet via preparing and conducting printing based thereon) can also be shortened.

As this type of a conventional fixing device, Japanese Patent Application Publication No. 2007-334205 (JP-2007-334205-A) discloses a device that includes an endless belt (e.g., an fixing belt) 100, a pipe-shaped metal heat conductor 200 disposed inside a loop of the endless belt 100, a heat source 300 disposed in the metal heat conductor 200, and a pressing roller 400 contacting the metal heat conductor 200 via the endless belt 100 forming a nip N thereon as shown in FIG. 15. The endless belt 100 is driven and rotated when the pressing roller 400 rotates. The metal heat conductor 200 guides and allows the endless belt 100 to travel at this moment. Since the endless belt 100 is heated by the heater 300 via the metal heat conductor 200, the entire endless belt 100 can be heated. Thus, the time to first print from a heat standby state can be reduced and moreover the problem of insufficient heat during high speed rotation can be resolved.

Further, Japanese Patent Application Publication No. 2007-233011 (JP-2007-233011-A) also proposes a fixing device that directly (i.e., not via the metal heat conductor) heats the endless belt to further enhance energy efficiency and the time to fast print as shown in FIG. 16.

Further, the pipe-shaped metal heat conductor is sometimes omitted from inside the loop of the endless belt 100, and instead, a nip formation member 500 having a sheet plate shape is provided facing the pressing roller 400. Consequently, since the endless belt 100 can be partially directly heated by the heat source 300 other than a nip formation section of the nip formation member 500, heat transfer efficiency can be greatly improved, thereby reducing power consumption. Because of this, the time to first print from a heating standby state can be further reduced, achieving cost reduction due to omission of the metal heat conductor.

Due to a malfunction or the like (e.g., a system error) of the image forming apparatus, there is a risk that a heat source of the above-described fixing device overheats damaging the fixing belt. To prevent this, a thermostat with a bimetallic strip or the like is provided in the fixing device as a safety device. However, when the temperature of the fixing belt exceeds a prescribed level, power to the heat source is shut off by the thermostat, and a control unit senses a malfunction and stops rotation of the fixing belt, shutting the machine shut down.

However, as shown in FIG. 16, since the heat capacity of the fixing belt is small, the heated fixing belt heats up quickly when heated directly. At the same time, however, the bimetal thermostat has low responsiveness. Consequently, a time lag develops from the time when the fixing belt is overheated to the time when power to the heat source is actually shut off, by which time the fixing belt is likely to have been damaged already.

To prevent this possibility, the thermostat of the safety device can be replaced with a temperature sensor, such as a thermistor, etc. However, such a sensor detects even slight variations in the temperature of the fixing belt, possibly causing the control unit to mistakenly interpret transitory fixing belt temperature overshoots as system malfunctions and shut down the machine even though the machine is operating normally. Frequent shutdowns can be a nuisance. In such a situation, the thermostat can be cooled by a cooling device, such as a fan, etc., but such a configuration increases the cost and the size of the apparatus.

SUMMARY OF THE INVENTION

Accordingly, the present invention provides a novel fixing device that includes a rotatable fixing member to apply heat to a recording medium bearing an unfixed image thereon, a heat source to heat the fixing member, and a rotatable pressing member pressing against the fixing member. A nip formation member is opposed to the pressing member in the fixing member to form a fixing nip between the fixing member and the pressing member. A conveyance path is provided to convey the recording medium via the fixing nip. A sheet ejection member is provided to receive and transport the recording medium ejected from the fixing nip. The sheet ejection member is disposed downstream of the fixing nip in the conveyance path. A controller stops rotation of the fixing member while the recording medium is being transported by the sheet ejection member after passing through the fixing nip.

In another aspect of the present invention, the heat source is turned off before the fixing member stops the rotation.

In yet another aspect of the present invention, temperature of the fixing member is detected by a temperature detector, wherein the fixing member dissipates heat in accordance with a detection value detected by the temperature detector.

In yet another aspect of the present invention, the fixing member is rotated for a prescribed time period after a fixing process.

In yet another aspect of the present invention, the fixing member is rotated until temperature detected by the temperature detector is below a prescribed level.

In yet another aspect of the present invention, the controller changes an amount of heat dissipated from the fixing member by changing an interval between continuously fed recording sheets.

In yet another aspect of the present invention, the overheat safety device turns off the relay when temperature detected by the temperature detection member reaches a prescribed upper limit.

In yet another aspect of the present invention, the overheat safety device turns off the relay without converting a detection signal of the temperature detector into temperature.

In yet another aspect of the present invention, the heat source is formed from a halogen heater.

In yet another aspect of the present invention, the fixing member and the sheet ejection member are driven and rotated by separate rotary actuators, respectively.

In yet another aspect of the present invention, the heat is dissipated from the fixing member when the detection value detected by the temperature detector exceeds a prescribed level.

In yet another aspect of the present invention, the heat is dissipated from the fixing member when a gradient of the temperature detected by the temperature detector exceeds a prescribed level.

In yet another aspect of the present invention, an image forming apparatus has the above-described fixing device.

BRIEF DESCRIPTION OF THE SEVERAL VIEWS OF THE DRAWINGS

A more complete appreciation of the present invention and many of the attendant advantages thereof will be more readily obtained as substantially the same becomes better understood by reference to the following detailed description when considered in connection with the accompanying drawings, wherein.

DETAILED DESCRIPTION OF THE INVENTION

Figure 1:
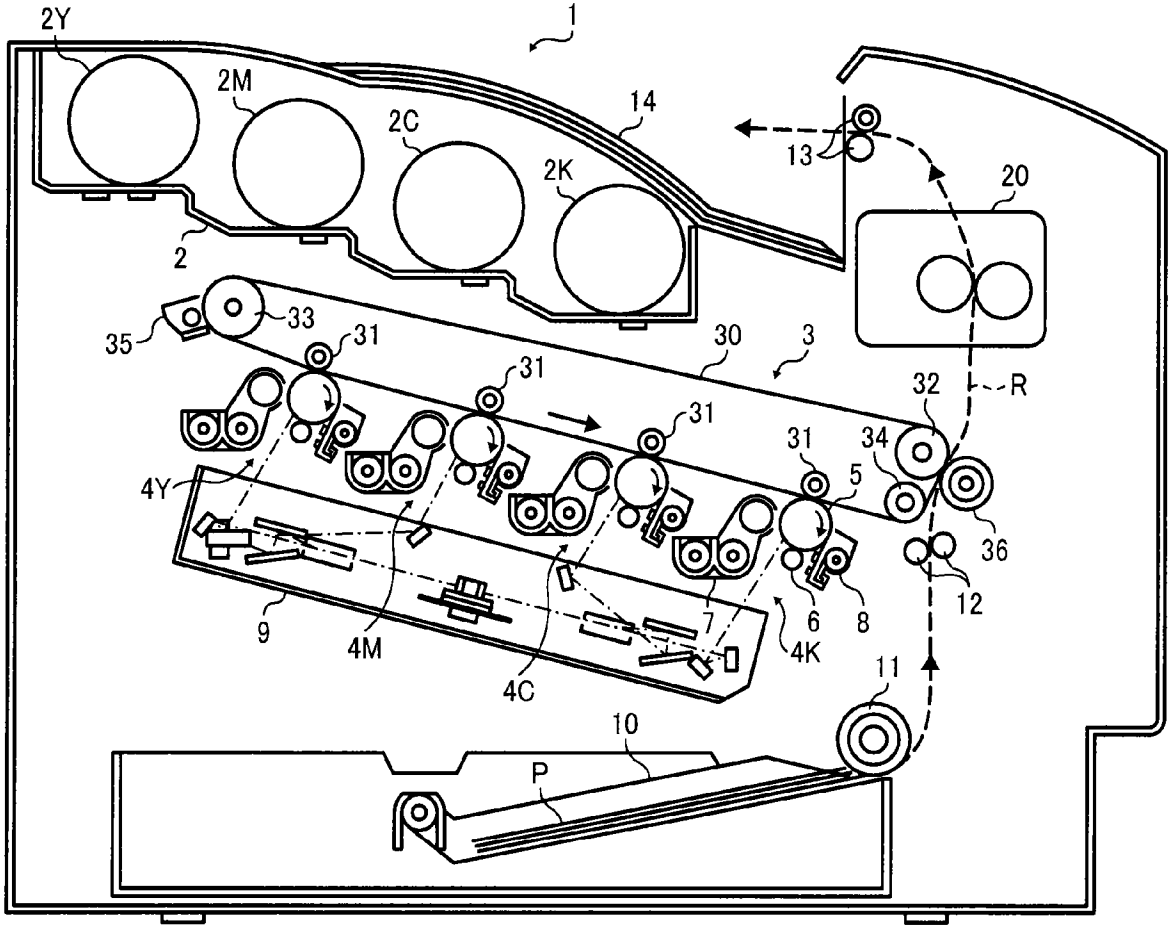
FIG. 1 is a cross-sectional view illustrating a schematic configuration of an image forming apparatus according to one embodiment of the present invention.

Referring now to the drawings, wherein like reference numerals designate identical or corresponding parts throughout the several views thereof and in particular to FIG. 1, an overall configuration and operation of an image forming apparatus according to one embodiment of the present invention is described. The image forming apparatus 1 of FIG. 1 is a color laser printer having four image forming units 4Y, 4M, 4C, and 4K at a center of an apparatus main body. Each of the four image forming units 4Y, 4M, 4C, and 4K accommodates different color developer corresponding to a color component of yellow (Y), magenta (M), cyan (C), and black (K). However, each of the four image forming units 4Y, 4M, 4C, and 4K has a similar configuration.

Specifically, each of the four image forming units 4Y, 4M, 4C, and 4K is provided with a drum shaped photoconductor 5 serving as a latent image-bearing body, a charging device 6 to charge a surface of the photoconductor 5, a developing device 7 to supply toner to the photoconductor 5, and a cleaning device 8 to clean the surface of the photoconductor 5. As shown in FIG. 1, the black photoconductor 5, the charging device 6, the developing device 7, and the cleaning device 8 each provided in the image forming unit 4K only have affixed signs, respectively, and the other image forming units 4Y, 4M, and 4C omit the affixed signs, respectively.

Below the image formation units 4Y, 4M, 4C, and 4K, an exposure unit 5 is disposed to expose the surface of the photoconductive member 5. The exposure unit 9 has a polygon mirror, an f-θ (theta) lens, a reflector mirror, and a light source or the like and irradiates laser light onto each surface of the photoconductive member 5 based on image data.

Above the image formation units 4Y, 4M, 4C, and 4K, a transfer unit 3 is disposed. The transfer unit 3 includes an intermediate transfer belt 30 as a transfer member, four primary transfer rollers 31 as a primary transfer device, a secondary transfer roller 36 as a secondary transfer device, a secondary transfer backup roller 32, a cleaning backup roller 33, a tension roller 34, and a belt cleaning device 35.

The intermediate transfer belt 30 is an endless-belt and is stretched around the secondary transfer backup roller 32, the cleaning backup roller 33, and the tension roller 34. The intermediate transfer belt 30 circulates in a direction as indicated by arrow in the drawing as the secondary transfer backup roller 32 rotates.

The four primary transfer rollers 31 respectively form primary transfer nips holding the intermediate transfer belt 30 with each photoconductor 5 therebetween. A power supply, not illustrated, is connected to each of the primary transfer rollers 31, and a given direct current voltage (DC) and/or an alternating current voltage (AC) is applied to the each of the primary transfer rollers 31 therefrom.

The secondary transfer roller 36 holds the intermediate transfer belt 30 together with the secondary transfer backup roller 32 forming a secondary transfer nip thereon. Further, similar to the primary transfer roller 31, a power supply, not shown, is connected to the secondary transfer roller 36, and a given direct current voltage (DC) and/or an alternating current voltage (AC) is applied to the secondary transfer roller 36 therefrom.

The belt cleaning unit 35 includes a cleaning blade and a cleaning brush each contacting the intermediate transfer belt 30. A waste toner transfer hose, not shown, extending from the belt cleaning device 35 is connected to an entrance of a waste toner accommodating instrument, not shown.

A bottle container 2 is provided at an upper section in a printer body. To the bottle container 2, four toner bottles 2Y, 2M, 2C, and 2K each storing toner to be replenished are detachably attached. Multiple supply paths, not shown, are provided between the developing device 7 and the toner bottles 2Y, 2M, 2C, and 2K, respectively, so that toner is supplied to each developing device 7 from each of the toner bottles 2Y, 2M, 2C, and 2K via the supply path.

At a bottom of the printer body, a sheet feeding tray 10 accommodating sheets P as a recording medium and a sheet feeding roller 11 to feed the sheet P from the sheet feeding tray 10 are provided. The recording medium includes a cardboard, a postcard, an envelope, a thin sheet, a coated sheet (e.g., a coated sheet, an art sheet, etc.), a tracing paper sheet, and an OHP (Over Head Projector) sheet or the like beside a plain paper sheet. Although, it is not shown, a manual sheet feeding mechanism may be provided.

A conveying path R is disposed to convey the sheet P from the sheet feeding tray 10 to an outside of the printer body through the secondary transfer nip. On the conveying path R, a pair of registration rollers 12 is disposed upstream of the secondary transfer roller 36 in a sheet conveying direction as a transportation device to convey the sheet P to the secondary transfer nip.

Further, a fixing device 20 is disposed on the downstream side of the secondary transfer roller 36 in the sheet conveying direction to fix an unfixed image transferred onto the sheet P. A pair of sheet ejection rollers 13 is provided downstream of the fixing device 20 in the sheet conveying direction on the conveyance path R to eject the sheet outside the apparatus. On the top of the printer body, a sheet ejection tray 14 is provided to stock sheets P ejected outside the apparatus.

Now, a basic operation of the printer according to one embodiment of the present is described with reference to FIG. 1. When image forming starts, each photoconductor 5 in each of the image formation units 4Y, 4M, 4C, and 4K is driven and rotated clockwise in the drawing by a driving device, not shown. Then, the surface of each photoconductive member 5 is uniformly charged by the charging device 6 to have a given polarity. Subsequently, laser light is emitted from the exposure device 9 onto a surface of the each of the uniformly charged photoconductors 5, and an electrostatic latent image is formed thereon. Here, each photoconductive member 5 is exposed to light having monochromatic image information of yellow, magenta, cyan, and black generated by resolving a prescribed full-color image. Accordingly, when toner is supplied to the electrostatic latent image formed on each photoconductor 5 by each developing device 7 in this way, the electrostatic latent image is rendered to be a sensible image as a toner image (i.e., image visualization).

Further, when image formation starts, the secondary transfer backup roller 32 rotates and operates counterclockwise in the drawing and circulates the intermediate transfer belt 30 as shown by arrow therein. To each primary transfer roller 31, a voltage subjected to either a constant current or constant voltage control having an opposite polarity to a charge polarity of toner is applied. Hence, a transfer electric field is formed between each photoconductor 5 and each primary transfer roller 31 at the primary transfer nip.

When a toner image of each color borne on the photoconductor 5 reaches the primary transfer nip as each photoconductor rotates, the toner image on each photoconductor 5 is transferred and superimposed on the intermediate transfer belt 30 one by one at the above primary transfer nip in the transfer field. Thus, a full-color toner image is borne on the surface of the intermediate transfer belt 30. Further, toner not transferred from each photoconductor 5 to the intermediate transfer belt 30 is removed therefrom by a cleaning device 8. After that, charge on the surface of each photoconductor 5 is eliminated by a charge eliminator, not shown, so that a surface potential thereof is initialized.

At the bottom of the image forming apparatus 1, the sheet feed roller 11 starts rotation driving so that a sheet P is sent from the sheet feeding tray 10 to the conveyance path R. The sheet P sent to the conveyance path R is transported by the pair of registration rollers 12 to the secondary transfer nip formed between the secondary transfer roller 36 and the secondary transfer backup roller 32 at a prescribed time. At this moment, a transfer voltage having a reverse polarity to a charge polarity of a toner image on the intermediate transfer belt 30 is applied to the secondary transfer roller 36. Thus, a transfer field is formed at the secondary transfer nip.

After that, when it reaches the secondary transfer nip as the intermediate transfer belt 30 circulates, the toner image on the intermediate transfer belt 30 is transferred onto the sheet P at once in the transfer field formed at the secondary transfer nip. Residual toner not transferred from the intermediate transfer belt 30 onto the sheet P is removed therefrom by a cleaning device 35. The thus removed toner is then transported to a waste toner accommodating instrument, not shown, and thereby collected therein.

After that, the sheet P is transported to the fixing device 20 and the toner image is fused thereon by the fixing device 20. Subsequently, the sheet P is discharged by the sheet ejection roller 13 to an outside of the device and is stocked on the sheet ejection tray 14.

Although the above-described embodiment relates to full-color image formation on a sheet, a monochromatic image can be formed using four image formation units 4Y, 4M, 4C, and 4K. Twin or trivalent color images can also be formed using two or three image formation units.

Figure 2:
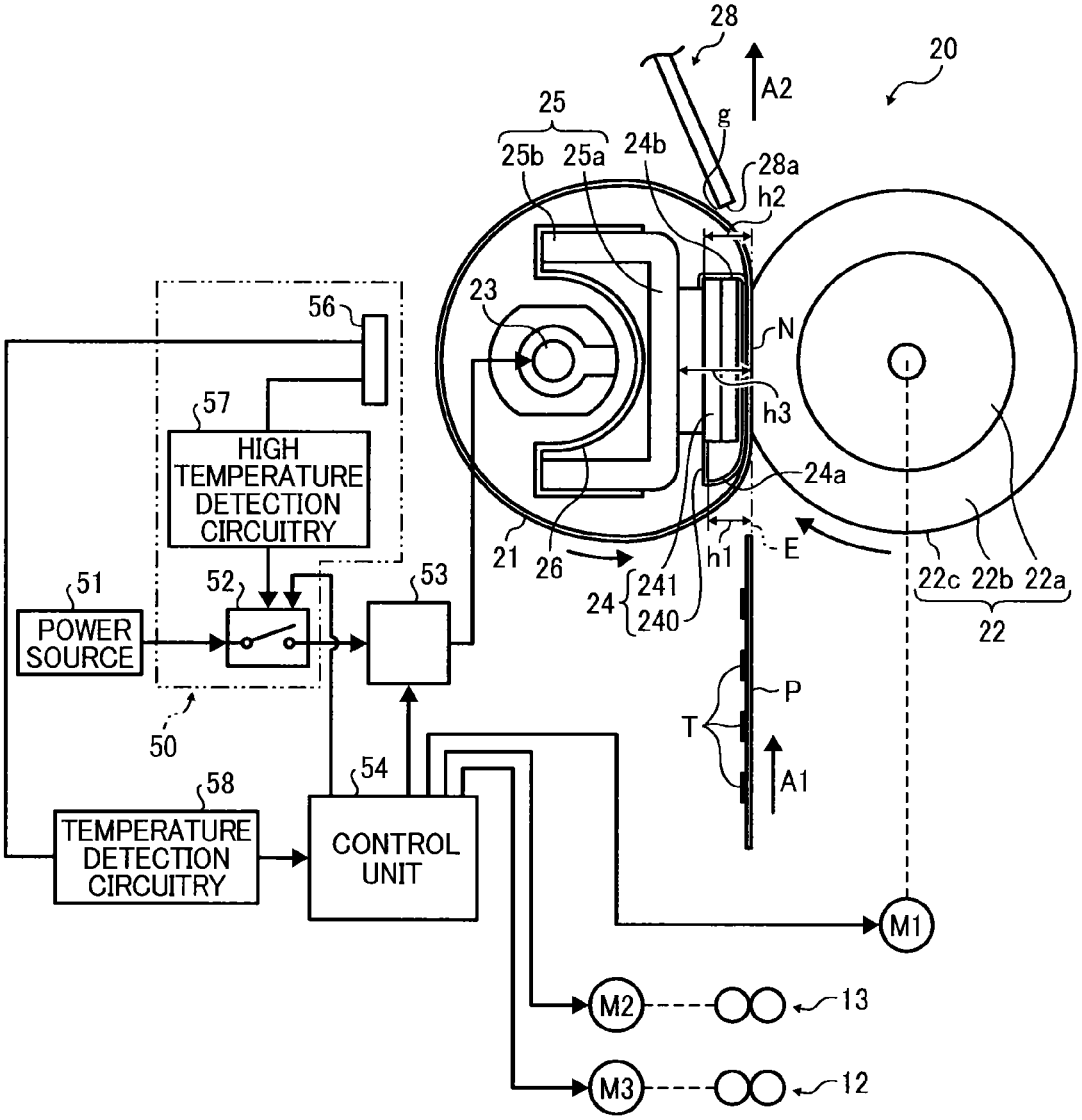
FIG. 2 is a cross-sectional view illustrating a fixing device mounted in the image forming apparatus and a control device therefor.

Now, a configuration of the above fixing device 20 is described more in detail with reference to FIG. 2. As shown there, the fixing device 20 includes a fixing belt 21 as a rotatable fixing member, a pressing roller 22 located opposite the fixing belt 21 as a rotatable pressing member, and a halogen heater 23 to a heat the fixing belt 21 as a heat source. The fixing device 20 further includes a nip formation member 24 disposed inside the fixing belt 21, a stay 25 as a support member to support the nip formation member 24, and a reflective member 26 to reflect light emitted from the halogen heater 23. The fixing device 20 further includes a separation member 28 to separate a sheet from the fixing belt 21 and a pressing device, not shown, to press the pressing roller 22 against the belt fixing 21 or the like.

The above-described fixing belt 21 is composed of a thin-walled flexible endless belt member (including a film) to heat a side of a sheet P bearing an unfixed image. Specifically, an inner circumferential substrate of the fixing belt 21 is made of metal, such as nickel, SUS, etc., or plastic, such as polyimide (PI), etc. An outer circumferential release layer is made of tetrafluoroethylene-perfluoroalkyl vinyl ether copolymer (PFA), and polytetrafluoroethylene (PTFE) or the like. Further, it is possible to insert an elastic layer made of rubber, such as silicone rubber, foamed silicone rubber, fluoro rubber, etc., between the substrate and the release layer.

The above-described pressing roller 22 includes a metal core 22*a*, an elastic layer 22*b* made of a foam silicone rubber, silicone rubber, or fluorine rubber, etc., disposed overlying the metal core 22*a*, and a release layer 22*c* consisting of PTFE and PFA or the like disposed overlying the surface of the elastic layer. The pressing roller 22 is pressed against the fixing belt 21 by a pressing device, not shown, and contacts the nip formation member 24 via the fixing belt 21. In a contacting region in which the pressing roller 22 and the fixing belt 21 contact in pressure with each other, the elastic layer 22*b* of the pressing roller 22 is crushed and a nip N is formed with a given width. The pressing roller 22 is configured to rotate when driven by a rotation driving source M1, such as a motor, etc. When the pressing roller 22 is driven and rotated, a driving force thereof is transmitted to the fixing belt 21 through the nip N, and the fixing belt 21 is thereby driven and rotated.

In this embodiment, the pressing roller 22 is a solid state, but can be a hollow roller. In such a situation, a heat source, such as a halogen heater, etc., can be disposed inside the pressing roller 22. Further, in absence of the elastic layer, a heat capacity decreases while improving fixative. However, when an unfixed toner is crushed and fixed, fine convexoconcave on the surface of the belt is transferred onto an image thereby causing shiny irregularity in a solid image. To prevent that, a thick elastic layer having a thickness of more than 100 micrometers is desirably provided. That is, since the fine convexoconcave can be absorbed by elastic deformation of the elastic layer having the thickness of more than about 100 micrometer, occurrence of glossy irregularity can be avoided. The elastic layer 22*b* may be made of solid rubber or sponge rubber when a heat source is not installed in the pressing roller 22. The sponge rubber is more desirable, because it increases thermal insulation performance and heat of the fixing belt 21 is more rarely deprived. Further, the fixing belt 21 and the pressing roller 22 are not limited to those contacting each other, but can simply contact each other without pressure.

Each side end of the above-described heater 23 is secured to each side plate (not shown) of the fixing device 20. The halogen heater 23 is controlled to generate and output heat, so that temperature (i.e., fixing temperature) of the fixing belt 21 can be a desired level by controlling an output of the halogen heater 23. However, as a heat source to heat the fixing belt 21, an IH (Induction Heater), a heat resistance member, and a carbon heater or the like may be used other than the halogen heater.

The above-described nip formation member 24 has a base pad 241 and a sliding sheet (e.g., a sheet with low-friction) 240 disposed on the surface of the base pad 241. The base pad 241 longitudinally extends along an axis of the fixing belt 21 (or the pressing roller 22) and receives pressure from the pressing roller 22, thereby defining a shape of the nip N. The base pad 241 is fixed and supported by a stay 25. Hence, deflection of the nip formation member 24 caused by the pressure of the pressing roller 22 is substantially prevented, so that a uniformed nip width can be obtained along the axis of the pressing roller 22. To ensure performance of preventing the deflection of the nip formation member 24, the stay 25 is preferably made of metal such as iron, stainless steel, etc., having high mechanical strength. In this embodiment, a surface of the base pad 241 opposed to the pressing-roller 22 is formed flat, so that a shape of the nip N is straight. With the straight shape of the nip N, the pressing force of the pressing roller 22 can be reduced.

The base pad 241 is made of hard and heat-resistant material capable of withstanding temperature up to 200° C. or more to ensure prescribed rigidity. Hence, deformation of the nip formation member 24 due to the heat is substantially prevented while stabilizing a condition of the nip N with high quality of an output image at a toner fixing temperature. As material of the base pad 241, general heat-resistant resin, such as polyethersulphone (PES), polyphenylene sulfide (PPS), liquid crystal polymer (LCP), polyether nitrile (PEN), polyamide imide (PAI), polyetheretherketone (PEEK), etc., metal, and ceramic or the like can be used.

The sliding sheet 240 is preferably disposed at least on a surface of the base pad 241 opposed to the fixing belt 21. Hence, since the fixing belt 21 slides and rotates on the low friction sheet, a drive torque and load on the fixing belt 21 caused by the friction can be decreased. However, the sliding sheet 240 can be omitted.

The above-described reflection member 26 is disposed between the stay 25 and the halogen heater 23. The reflective member 26 is secured to the stay 25 and is made of stainless steel or aluminum and the like in this embodiment. Since the reflection member 26 is disposed in this way, light emitted from the halogen heater 23 toward the stay 25 is reflected to the fixing belt 21. Hence, an intensity of light emitted to the fixing belt 21 can be increased, thereby capable of efficiently heating the fixing belt 21. Further, since radiant heat traveling from the halogen heater 23 to the stay 25 or the like can be suppressed, energy can be saved.

Although it is not shown in the drawing, at both side ends of the fixing belt 21 in its axial direction, a pair of shielding members blocking heat dissipated from the halogen heater 23 is disposed between the fixing belt 21 and the heater 23. With these, overheating in non-sheet passage regions on the fixing belt can be suppressed especially when sheets are continuously fed, so that damage or deterioration of the fixing belt due to the dissipated heat can be substantially prevented.

Although it is not shown in the drawing, both side ends of the fixing belt 21 in its axial direction are held by a belt holding member inserted into an inner circumference thereof. In this way, by keeping only the both side ends of the fixing belt 21 with the holding member 40, the fixing belt 21 can freely deform between the both side ends other than the nip N. Further, since the nip N has the straight shape, prescribed force is always applied to the fixing belt 21 to transform it into an elliptical shape. Thus, the fixing belt 21 almost has a true round cross section in a radius direction during its rotation at each of the side ends, and changes the shape into the elliptical shape having a minor axis in a normal direction of the nip N between the side ends.

Further, various ideas are applied to the fixing device 20 of this embodiment to further save energy shortening a first printing time period as described below.

Specifically, the halogen heater 23 is enabled to directly heat the fixing belt 21 at a section other than the nip N as a direct heating system. Specifically, without providing any devices between the halogen heater 23 and a left side section of the fixing belt 21 in FIG. 2, radiant heat is directly transferred from the halogen heater 23 to the fixing belt 21 there.

Further, to decrease a heat capacity of it, the fixing belt 21 is made thin while decreasing a diameter thereof. Specifically, thicknesses of the substrate, the elastic layer, the release layer collectively constituting the fixing belt 21 are from about 20 μm to about 50 μm, from about 100 μm to about 300 μm, and from about 10 μm to about 50 μm, respectively, so that the whole thickness is less than 1 mm. Further, a diameter of the fixing belt 21 is from about 20 mm to about 40 mm. In order to achieve the low heat capacity, the entire thickness of the fixing belt 21 is desirably less than about 0.2 mm, and is more preferably less than about 0.16 mm. A diameter of the fixing belt 21 is desirably about 30 mm or less.

Further, in this embodiment, a diameter of the pressing roller 22 is from about 20 mm to about 40 mm almost equivalent to that of the fixing belt 21. It is, however, not limited to each of these sizes. For example, the diameter of the fixing belt 21 may be smaller than that of the pressing roller 22. In such a situation, since a curvature of the fixing belt is smaller than that of the pressing roller 22 at the nip N, the sheet P to be ejected from the nip N is readily separated from the fixing belt 21.

Further, as result of decreasing the diameter of the fixing belt 21 as described above, an inner space of the fixing belt 21 accordingly becomes narrower. However, since the stay 25 is bent at its both side ends forming a rectangular shape to accommodate the halogen heaters 23 therein, the stay 25 and the halogen heater 23 can be layout even in a small space.

Further, to make the stay 25 as large as possible and arrange it in the small space, the nip formation member 24 is made compact to the contrary. Specifically, a width of the base pad 241 is smaller than that of the stay 25 in the sheet conveying direction. Further, as shown in FIG. 2, the base pad 241 is located in a prescribed position as described below. When respective heights from respective upstream and downstream side edges 24*a* and 24*b* of the base pad 241 in the sheet conveying direction to the nip N or its virtual extension line "E" are represented by h1 and h2, and a maximum height from a section other than the upstream and downstream side edges 24*a* and 24*b* to the nip N or its virtual extension line "E" is represented by h3, the following equality is satisfied; h1≤h3 and h2≤h3. With such a configuration, both the upstream and downstream side edges 24*a* and 24*b* of the base pad 241 do not intervene between respective bent portions of the stay 25 on both upstream and downstream sides in the sheet conveying direction and the fixing belt 21, each bent portion can be disposed closer to the inner circumferential surface of the fixing belt 21. Hence, the stay 25 can be arranged in a limited space of the fixing belt 21 as wide as possible keeping its strength. As a result, deflection of the nip formation member 24 caused by the pressing roller 22 can be avoided improving fixing performance.

Further, in this embodiment, to further ensure strength of it, the stay 25 includes a base section 25A extending in the sheet conveying direction (i.e., a vertical direction in FIG. 2) contacting the nip formation member 24, and a pair of rising portions 25*b* extending from upstream and downstream sides of a base section 25A in the sheet conveying direction departing from the pressing roller 22 (i.e., a left side in FIG. 2). That is, due to the rising portions 25*b*, the stay 25 has a long cross section from side to side extending in a pressing direction of the pressing roller 22, so that its modulus of section and accordingly mechanical strength of the stay 25 can increase.

Further, strength of the stay 25 increases if a length of the rising portion 25*b* is increased in the pressing direction of the pressing roller 22. Therefore, a tip of the rising portion 25*b* is desirably positioned beside an inner circumferential surface of the fixing belt 21 as closer as possible. However, since it somewhat vibrates (i.e., disorder movement) during its rotation, the fixing belt 21 likely contacts the tip of the rising portion 25*b* if the tip of the rising portion 25*b* is excessively close to the inner circumferential surface of the fixing belt 21. Especially, when a thin fixing belt 21 is utilized as in this embodiment, since a size of vibration amplitude of the fixing belt 21 is large, the tip of the rising portion 25*b* needs to be carefully set and positioned.

Specifically, a distance "d" between the tip of the rising portion 25*b* and the inner circumferential surface of the fixing belt 21 in the pressing direction of the pressing roller 22 is preferably at least 2.0 mm, and is more preferably greater than 3.0 mm in this embodiment. Whereas, when the fixing belt 21 is thick by some extent and rarely vibrates, the above-described distance "d" can be set to about 0.2 mm. If the reflection member 26 is attached to the tip of the rising portion 25*b* as in this embodiment, the above-described distance "d" needs to be set to a prescribed level in that the reflective member 26 does not contact the fixing belt 21.

Hence, by positioning the tip of it beside the inner circumferential surface of the fixing belt 21 as closer as possible, the rising portion 25*b* can be elongated in the pressing direction of the pressing roller 22. With this, even when the fixing belt 21 with a small-diameter is used, the mechanical strength of the stay 25 can be increased.

Now, a basic operation of a fixing device according to this embodiment is described with reference to FIG. 2. When a power switch of a printer body is turned on, power is supplied to the halogen heater 23. The pressing roller 22 then starts driving clockwise in FIG. 2. Accordingly, the fixing belt 21 is driven and rotated counterclockwise by friction caused by the pressing roller 22 as shown there.

Subsequently, a sheet P bearing an unfixed toner image formed in the above-described image formation process is conveyed in a direction shown by arrow A1 of FIG. 2 while being guided by a guide plate, not shown, to a nip N formed between the pressing roller 22 and the fixing belt 21 under the pressure. Further, the toner image T is fused by heat of the fixing belt 21 and pressure between the fixing belt 21 and the pressing roller 22 onto the surface of the sheet P.

The sheet P with the fixed toner image T thereon is carried out in a direction as shown by arrow A2 from the nip N as shown in FIG. 2. A tip 28*a* of an separating member 28 located near an exit of the nip N is distanced from a surface of the fixing belt 21 forming an separating gap "g" therebetween. The sheet P conveyed from the nip N separates from the fixing belt 21 when contacting the tip 28*a* of the separating member 28 with its tip. Subsequently, the separated sheet P is exhausted outside the apparatus by a sheet ejection roller and is stocked on an output tray as described above.

Now, a control device controlling a fixing device 20 is described with reference to FIG. 2 as one of features of the present invention. As shown there, power supplied from the power source 51 is further supplied to the halogen heater 23 via a relay 52 and a triode AC switch 53. The relay 53 is a power relay type, so that power is supplied to the halogen heater 23 when the relay 53 is turned on (i.e., closed), and is cut off when it is turned off (i.e., open).

In the fixing device 20 according to one embodiment of the present invention, an overheat safety protection device 50 is provided in the control device as a safeguard device against overheating in the fixing belt 21. The overheat safety protection device 50 includes a temperature sensor 56 as a temperature detector to detect surface temperature of the fixing belt 21, the above-described relay 52, and a high temperature detection circuit 57 disposed between the temperature sensor 56 and the relay 52.

Figure 10:
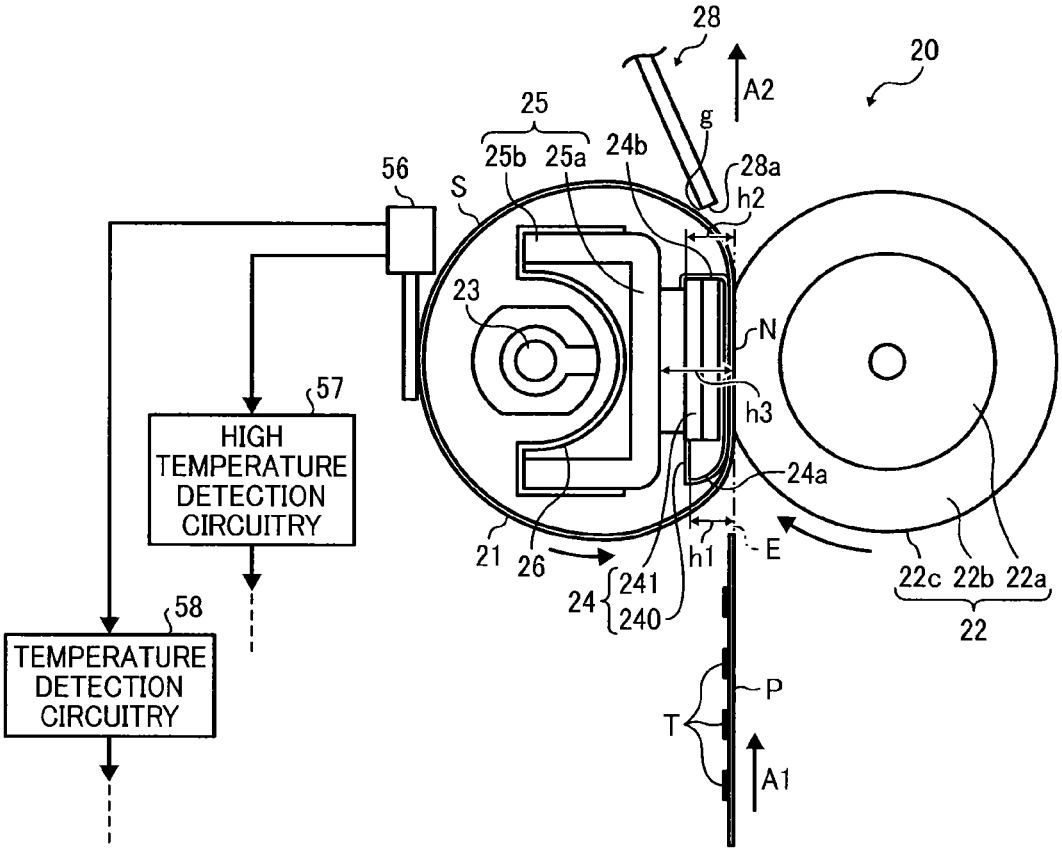
FIG. 10 is a cross-sectional view illustrating a fixing device and a control device therefor according to yet another embodiment of the present invention.

A high speed response device, such as a thermistor (TM), a thermocouple, etc., is used rather than a low speed response device, such as a bi-metal, etc., as the temperature sensor 56. As the temperature sensor 56, a contact type shown in FIG. 10 can be used beside a non-contact type shown in FIG. 2. For example, a model NC-F10 manufactured by SEMITEC corporation is available as the non-contact temperature sensor. A model 364 FL manufactured by the same corporation or the like can be used as the contact temperature sensor. Since it generally corrects detection result in accordance with environmental temperature (i.e., sensor's own temperature), the non-contact sensor generates great variation therein depending on the environmental temperature. By contrast, the contact sensor generates less variation in detection temperature depending on the environmental temperature. When a temperature sensor 56 is to be chosen, responsiveness, detection sensitivity, environmental dependency of detection capability, and cost or the like are considered beside the above described variation.

Figure 11:
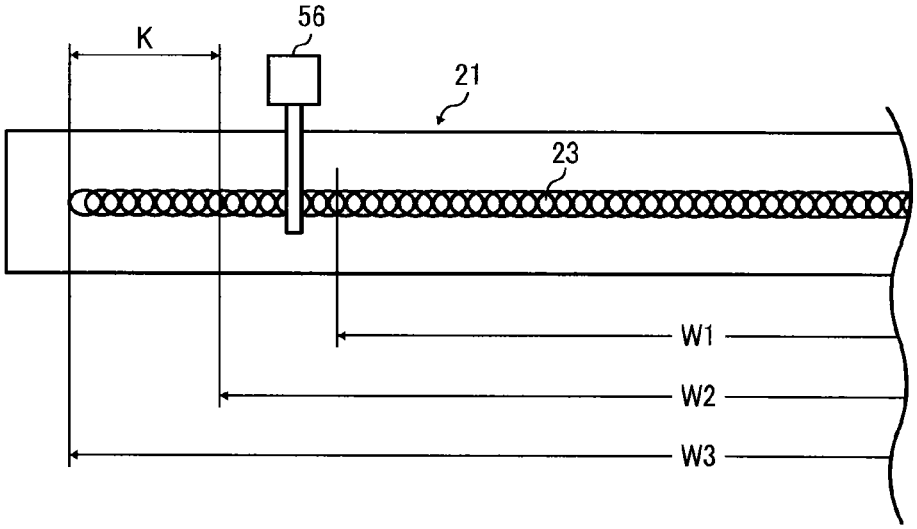
FIG. 11 is a front view of a fixing belt employed in the fixing device of the embodiment of FIG. 9.

A position of a temperature sensor in a longitudinal direction of the fixing belt 21 is not limited to one as far as a non-contact type is used. Whereas, a contact type sensor is desirably to be placed outside an image region W1 within a sheet passage region W2 as shown in FIG. 11. That is, if the contact sensor 56 is placed within the image region, a contact mark of the contact sensor likely appears as a glossy line. Further because, even if the temperature sensor 56 is placed in a region K within the heating region W3 outside the sheet passage region W2, the fixing belt 21 is not heated by the halogen heater 23 in the region K and temperature of the fixing belt 21 cannot be detected. If the glossy line and the other inconvenience do not raise an issue, the contact type sensor 56 can be disposed within the image region W1. Thus, when the temperature sensor 56 is placed in the image region W1 in this way, overheating of the fixing belt 21 described later in detail can be instantly detected and securely prevented substantially.

Further, the high temperature detection circuit 57 compares temperature information of a voltage outputted from the temperature sensor 56 with a predetermined reference. The high temperature detection circuit 57 turns off the relay 52 when the temperature information exceeds an upper limit capable of preventing damage on the fixing belt, for example about 260 degrees centigrade. A conversion process from the temperature information to temperature is not executed by control software or the like. Comparison of the temperature information as is with the reference is executed in the high temperature detection circuit 57. When the temperature information output from the temperature sensor 56 exceeds the reference equivalent to the upper temperature limit, the relay 52 is mechanically turned off. In this way, by controlling the overheat safety protection device 50 to switch the relay 52 off without converting a detection signal of the temperature sensor 56 into temperature, power supply to the halogen heater 23 can be rapidly cut off as an advantage when overheating occurs in the fixing belt 21. Further, a pair of high temperature detection circuits 57 is desirably disposed in parallel supposing its own malfunction even though only one circuit is shown in FIG. 2.

An output from the temperature sensor 56 is also inputted to a control unit 54 including a CPU or the like through the temperature detection circuit 58. The temperature detection circuit 58 converts temperature information value D sent from the temperature sensor 46 into a temperature value using control software, and transmits the temperature value to the control unit 54 via an AD converter, not shown.

Further, to output ports of the control unit 54, a triode AC switch 53 and a relay 52 are connected, respectively. Upon receiving a control signal from the control unit 54, the relay 52 is turned on during a warm-up stage, a print job-on stage, and a ready standby stage or the like. Whereas, the relay 52 is turned off during a power off stage, an off mode stage, an energy saving mode, and an urgent stopping stage or the like. The above-described switching on/off of the relay 52 is independently executed from switching off the relay 52 executed by the high temperature detection circuit 57 of the overheat safety protection device 50 without linking thereto. Further, a quantity of electricity is controlled in the triode AC switch 53 based on a control signal sent from the control unit 54. When the control unit 54 sends a control signal to the triode AC switch 53 based on a temperature conversion value D inputted from the temperature sensor 46 via the temperature detection circuit 58, an output from the halogen heater 23 is subjected to feedback control, so that temperature of the fixing belt 21 is maintained in a prescribed value. In the above-described system, an output of the halogen heater 23 is controlled by inputting an output of the temperature sensor 56 into the control unit 54. However, another temperature sensor can be newly provided beside that of FIG. 2 to detect surface temperature of the fixing belt 21 and an output of the heater 23 can be controlled by inputting temperature information from the other temperature sensor into the control unit 54.

Further, to the control unit 54, a fixing motor M1 for driving the fixing belt 21 and the pressing roller 22, a sheet ejection motor M2 for driving the sheet ejection roller 13, and a conveyance motor M3 for driving a registration roller 12 (see FIG. 1) for controlling an interval between sheets P are connected. With such a system, a driving condition, such as a rotational speed, rotation and stopping timing, etc., of each of the fixing belt 21, the sheet ejection roller 13, and the registration roller 12 can be independently controlled based on a control signal transmitted from the control unit 54.

In one embodiment of the present invention, a fixing motor M1, and accordingly a fixing belt 21, is stopped immediately after a trailing end of the sheet exits the fixing nip N and is still being transported by the sheet ejection roller 13. Whereas, in a conventional image forming apparatus, since a common motor is used to drive both the fixing roller 21 and the sheet ejection roller 13 simultaneously, these rollers 21 and 13 are rotated and stopped at the same time. However, according to one embodiment of the present invention, since the pressing roller 22 and the sheet ejection roller 13 are independently driven by respective motors M1 and M2 as described above, the pressing roller 22 can stop its rotation while the sheet ejection roller 13 continues to rotate. Thus, the fixing motor M1 is controlled to be able to temporarily stop its rotation during rotation of the sheet ejection motor M2 as described above.

In this way, by stopping the fixing motor M1 immediately after the trailing end of the sheet exits the fixing nip N, a time period for driving the pressing roller 22 can be decreased in comparison with a conventional device that simultaneously drives and stops both the pressing roller 22 and the sheet ejection roller 13. Further, in the conventional device, since the fixing motor M1 needs to drive not only the pressing roller 22 but also the fixing belt 21 while receiving a resistance due to sliding on the nip formation member 24 fixed to side plates, the fixing motor M1 consumes great power. Accordingly, if the fixing motor M1 is temporarily stopped during operation of the sheet ejection motor M2 after the sheet exits the fixing nip N completely as described above, a time for driving the fixing motor M1 can be shortened resulting in energy saving. Further, the fixing motor M1 can temporarily stop not only every sheet passage during continuous sheet passage, but also stops after multiple sheets have passed through the nip N.

These function and effect can be obtained when both the rollers 22 and 13 are enabled to be independently driven and stopped. Accordingly, as in the above described system that separately drives the sheet ejection roller 13 and the pressing roller 22 with the respective motors M1 and M2, a mechanism in which a clutch is placed on a torque transmission pathway between the common motor and the rollers 22 and 13 driven by the common motor is provided to independently rotate and stop the rollers 22 and 13 when switched can obtain the similar function and effect.

Also, as described-above, according to one embodiment of the present invention, the fixing belt 21 is directly heated in the fixing device 20 and the reflection member 26 limits a heat irradiation range for the fixing belt 21. Therefore, since the halogen heater 23 continuously heats the fixing belt 21 when it is stopped as described above, there is a risk that the fixing belt 21 is overheated instantly and is likely damaged. To also prevent such a problem the halogen heater 23 is turned off before the fixing motor M1 stops when the fixing motor M1 temporary stops, and is turned off all the time when the fixing motor M1 stops for an extended period of time. Such switching can be performed based on a prescribed control signal given from the control unit 54 to a triac switch (triode ac switch) 53. The halogen heater 23 is turned off when a sheet completely passes through the fixing nip N. However, the halogen heater 23 can be turned off even when a trailing end of the sheet remains in the fixing nip N.

Figure 14A:
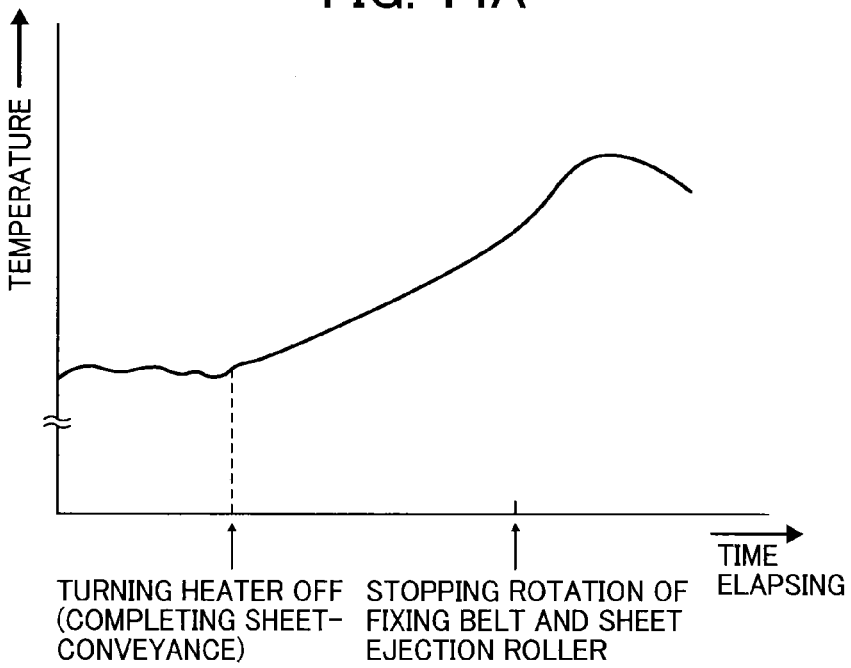
FIG. 14A illustrates a change in temperature of the fixing belt when the fixing belt is rotated after the halogen heater is turned off until the sheet ejection roller stops.
Figure 14B:
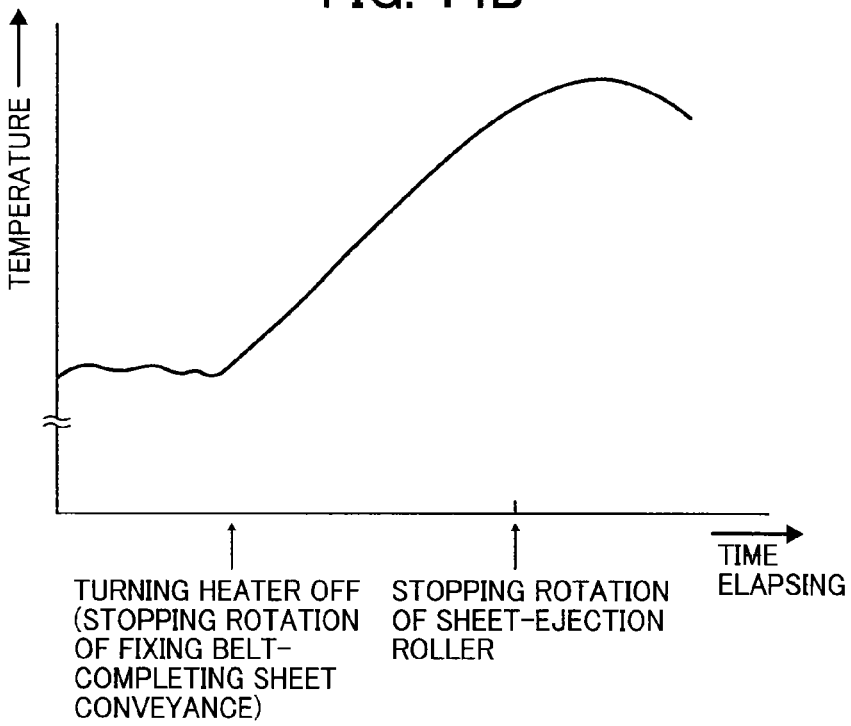
FIG. 14B also illustrates a change in temperature of the fixing belt when the fixing belt 21 stops its rotation substantially at the same time the halogen heater is turned off.
Figure 15:
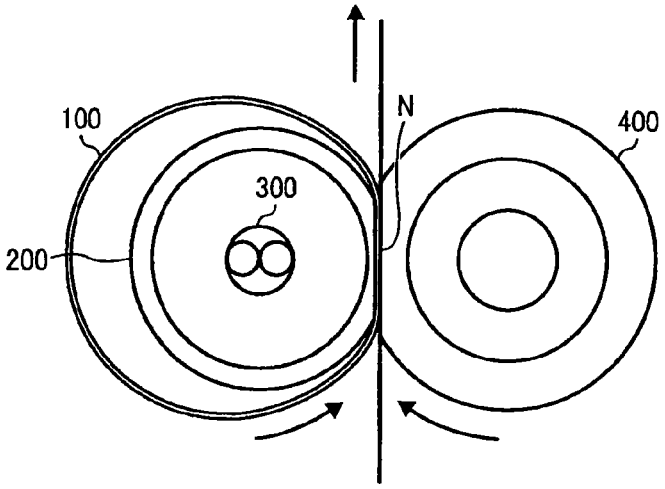
FIG. 15 PRIOR ART
FIG. 15 is a cross-sectional view illustrating a schematic configuration of a conventional fixing device.
Figure 16:
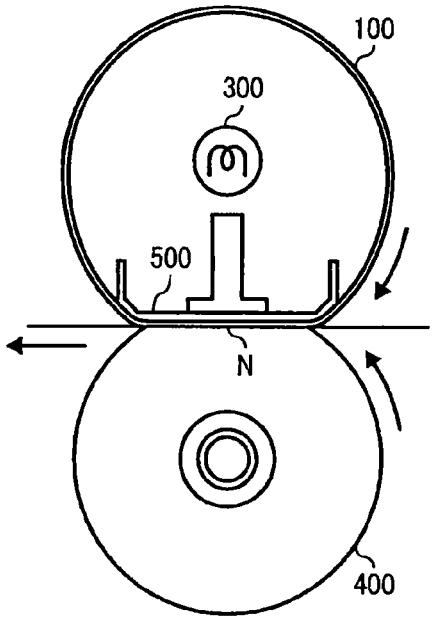
FIG. 16 PRIOR ART
FIG. 16 is a cross-sectional view illustrating a schematic configuration of another conventional fixing device.

Further, the halogen heater 23 is configured by sealing a heater and halogen (gas) within a glass tube. Accordingly, heat stored in the glass tube is dissipated even after the heater goes off. Accordingly, when the halogen heater 23 is used as a heat source, the fixing belt 21 is temporarily heated by residual heat remaining in the glass tube 23 even after the heater 23 goes off. Although heat is absorbed by a sheet during its passage through the fixing nip N, it is not absorbed after the trailing end of the sheet has exited the fixing nip N (i.e., completion of the sheet passage). Thus, temperature of the fixing belt rises as illustrated in FIGS. 14A and 14B. FIG. 14A illustrates a change in temperature of the fixing belt 21 when the fixing belt 21 is rotated after the halogen heater is turned off until the sheet ejection roller 13 stops. FIG. 14B also illustrates a change in temperature of the fixing belt 21 when the fixing belt 21 stops its rotation at substantially the same time the halogen heater is turned off. Here, FIGS. 14A and 14B illustrate a situation where sheet passage is completed at the same time the halogen heater 23 is turned off as one example.

In a fixing device 20 corresponding to FIG. 14A, since heat releasing yet occurs after the heater 23 goes off due to rotation of the fixing belt 21, temperature rise in the fixing belt 21 is relatively modest. By contrast, in the fixing device 20 corresponding to FIG. 14B, since the fixing belt 21 stops its rotation at the same time when the heater 23 goes off, heat dissipation does not occur and temperature of the fixing belt 21 accordingly rises sharply and exceeds the upper temperature limit therefor. As a result, the fixing belt 21 is likely damaged depending on its thermal heat storage condition.

Figure 3:
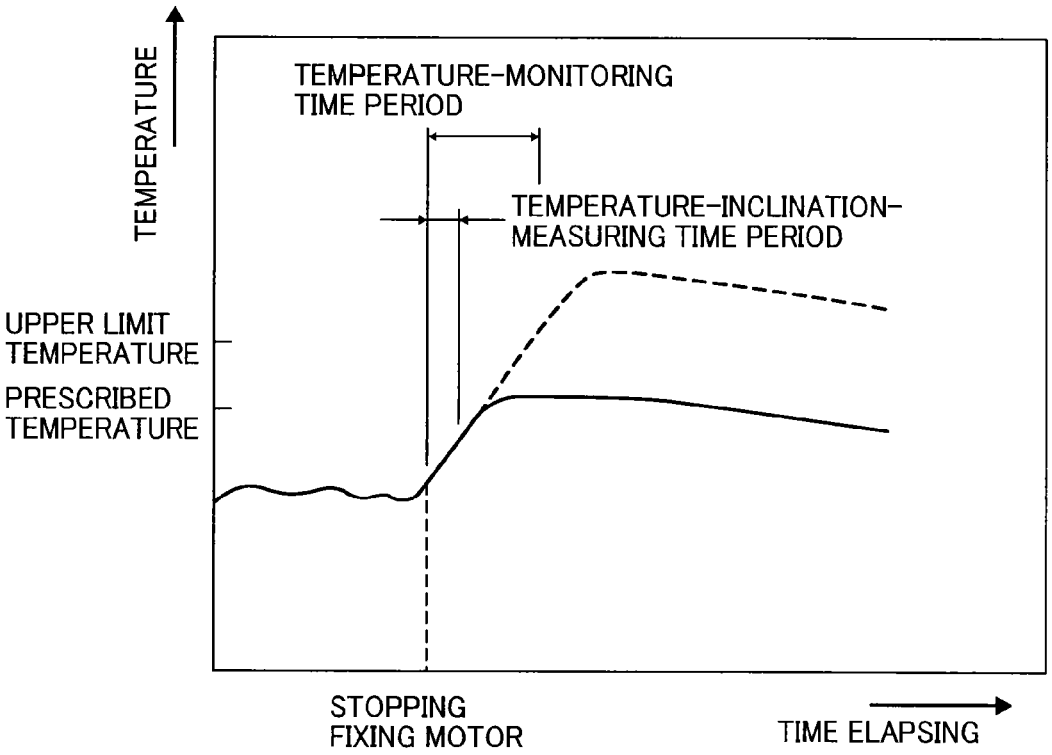
FIG. 3 is a diagram illustrating a change in temperature of the fixing belt after the fixing motor stops.

Hence, with the above-described investigation, heat is preferably dissipated from the fixing belt 21 in accordance with a temperature detection value of the temperature sensor 56 after the fixing belt 21 stops its rotation. Such heat releasing can be executed by rotating the fixing belt 21 with the fixing motor M1, for example. Specifically, as shown in FIG. 3, temperature of the fixing belt 21 is monitored for a prescribed time period (e.g., ten seconds) after the fixing motor M1 stops. Subsequently, the fixing motor M1 starts operation and circulates the fixing belt 21 to execute heat dissipation when a temperature conversion value D of the fixing belt 21 exceeds a prescribed temperature degree less than the upper limit. By this, overheating of the fixing belt 21 as shown by the solid line in FIG. 3 can be substantially prevented. The broken line in the drawing indicates a change in temperature of the fixing belt 21, when the fixing belt 21 is stopped when the heater 23 stops its operation and the stopping condition of the fixing belt 21 is maintained thereafter.

Figure 4:
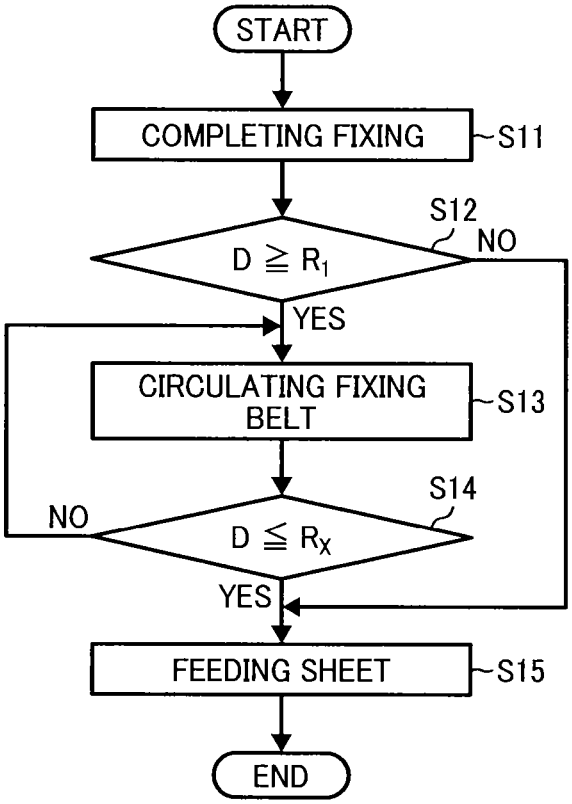
FIG. 4 is a flow chart illustrating one embodiment of the present invention.

Specifically, as shown in FIG. 4, if it is determined that a temperature conversion value D inputted to the control unit 54 from the temperature sensor 56 through the temperature detection circuitry becomes equal to or more than a first reference temperature R1 (e.g., about 220 degrees centigrade) after a precedent consolidation work is completed, the belt fixing 21 is rotated until the temperature conversion value D becomes less than the reference temperature Rx in this example to provide idling rotation. After that, when it is determined that the inequality D≤Rx is established, a next sheet is fed to the nip N and a fixing process is executed. Otherwise, the next sheet is fed through the fixing nip N after the fixing belt 21 is once stopped and is rotated again after that.

Now, another example of heat dissipation is described with reference to FIG. 5. As shown there by a flowchart, when it is determined that the inequality D≥R1 is established in FIG. 4, idling rotation for rotating the fixing belt 21 is provided and is timed up to a time period T1.

Further, the upper temperature limit reached by the fixing belt 21 after the fixing motor M1 stops and temperature of the fixing belt 21 rises can be estimated based on a percentage of a temperature rising degree per unit time (i.e. temperature gradient) after the stopping of the fixing motor M1 (see FIG. 3). A measurement time for measuring the temperature gradient can be less than the above-described temperature-monitoring time period, such as 1 to 3 seconds, etc., after the stopping of the fixing motor M1. Therefore, it can be immediately detected whether the fixing belt 21 is overheated. Consequently, in such a situation, since power to the entire image forming apparatus can be shut off immediately when it is judged that the fixing belt 21 is not overheated, energy can be saved.

Now, a situation where system abnormality occurs but power is continuously supplied to the halogen heater 23 in the above-described fixing device 20, and accordingly temperature of the fixing belt 21 exceeds the upper limit capable of maintaining its function during operation of the image forming apparatus is described. According to the overheat safety prevention device 50 of one embodiment of the present invention, when temperature information (i.e., a detected value) of the temperature sensor 56 reaches a reference value corresponding to a prescribed upper limit (for example, about 260 degrees Celsius), the relay 52 is switched off by the high temperature detection circuit 57 and power supply to halogen heater 23 is interrupted. With this, the overheating of the fixing belt 21, and accordingly damage thereon can be securely avoided. In such a situation, by using the above-described responsive sensor (e.g., a thermistor or a thermocouple) as a temperature sensor 56, a time lag from when temperature of the fixing belt 21 increases to when power supply to the halogen heater 23 is actually interrupted can be minimized, and damage on the fixing belt 21 by the time lag can be almost prevented.

Further, to avoid machine shut down caused by frequent operation of the above-described overheat safety prevention device 50, it is preferable that the fixing belt 21 dissipates heat rapidly during continuous sheet feeding by the image forming apparatus so as not to exceed the above-described upper temperature limit. Specifically, each unit of the image forming apparatus 1 is desirably controlled to dissipate heat from the fixing belts 21 in accordance with the temperature conversion value D entered into the control unit 54 from the temperature sensor 56 via the temperature detection circuit 58 during the continuous sheet feeding. Now, a specific example of heat dissipation is described in detail.

Now, a first example of heat dissipation is described. During continuous sheet feeding, temperature sometimes increases especially at side ends of the fixing belt 21. Such temperature rise in these side ends generally occurs when a small-sized sheet is fed as a problem. However, even when an ordinary sheet of a default size is repeatedly fed, temperature sometimes increases at side ends of the fixing belt 21 between a heating region heated by the halogen heater 23 and a non-sheet passage region.

When temperature increases at many sections of the fixing belt 21, such as one end thereof, etc., and reaches a prescribed level (for example, about 180 degrees Celsius), an interval between sheets (i.e., a feeding time difference between recording median continuously fed) is increased in a fixing process of the next stage even decreasing productivity. Specifically, dissipation of heat of the fixing belt 21 is accelerated during consecutive sheet feeding, so that temperature increase thereof can be suppressed. Here, expansion of the interval between sheets is executed by sending a control signal to the registration roller 12 from the control unit 54 as shown in FIG. 3.

Figure 5:
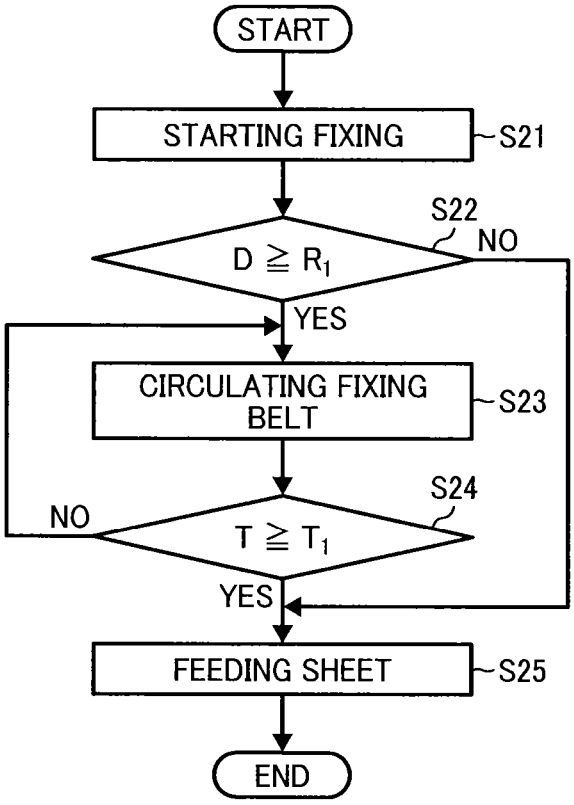
FIG. 5 is a flow chart illustrating another embodiment of the present invention.
Figure 6:
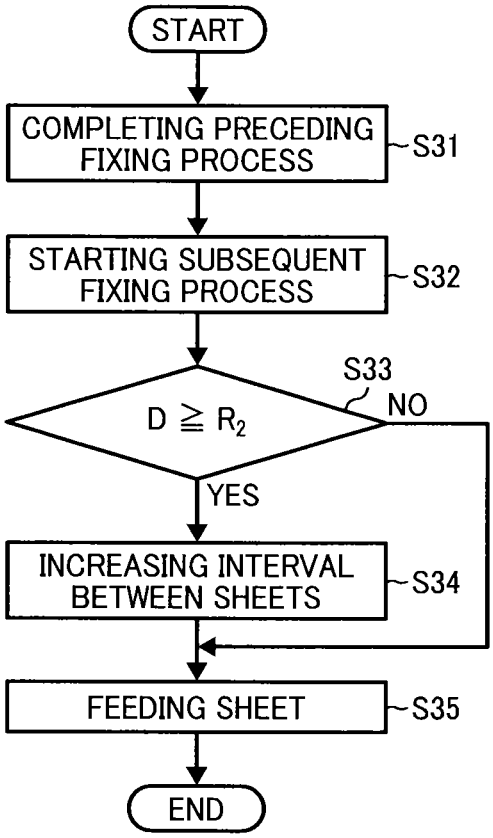
FIG. 6 is a flow chart illustrating yet another embodiment of the present invention.

Specifically, as shown in FIG. 5, an exemplary sequence of such control is executed as described below. Specifically, first of all, when a previous fixing operation is completed and that of the next is to be started during continuous sheet feeding, it is determine whether a temperature conversion value D entered into the control unit 54 is more than a first prescribed level R2 (e.g., about 180 degrees Celsius). If the inequality D<R2 is established, a sheet is fed to the nip N as is at the same interval between sheets as in the previous fixing process and an fixing process is executed. By contrast, if the inequality D≥R2 is established, the registration roller 12 increases an interval between sheets and a fixing process is then executed.

Now, a second example of heat dissipation is described. Even though an interval between sheets P is increased as in the first example, temperature of the fixing belt 21 sometimes continuously rises by some reason. Specifically, when temperature of the fixing belt 21 cannot be decreased only by increasing the interval between sheets in this way, the halogen heater 23 is stopped operating while the motor M1 is driven to rotate the pressing roller 22 and the belt fixing 21 to provide idling rotation to promote heat radiation of the fixing belt 21.

Figure 7:
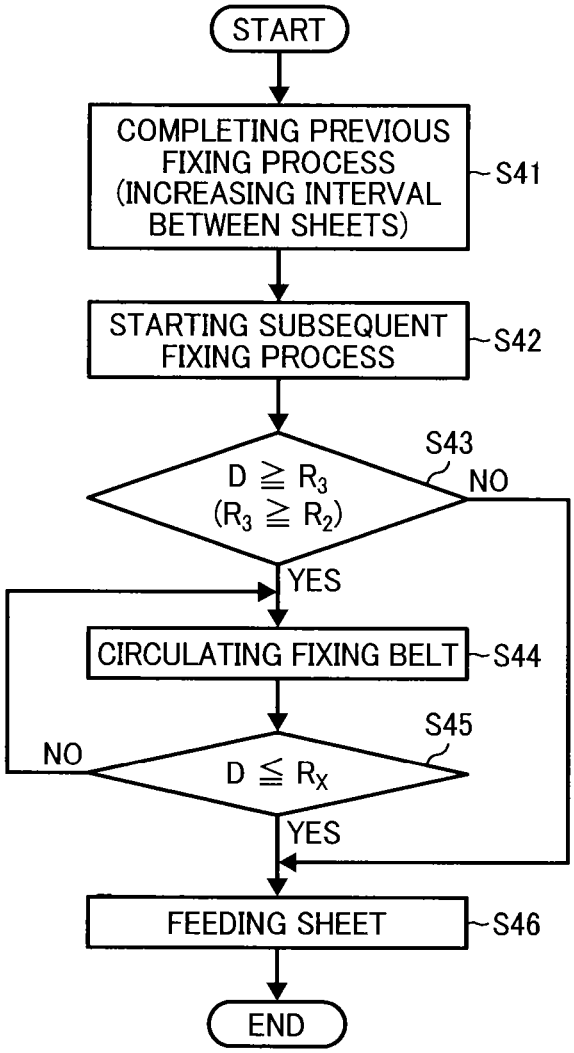
FIG. 7 is a flow chart illustrating yet another embodiment of the present invention.

Specifically, as shown in FIG. 7, when precedent fixing operation is completed with the increased interval between sheets and the next one is to be started, it is determine whether a temperature conversion value D entered into the control unit 54 from the temperature sensor 56 is more than a prescribed second level R3 (e.g., about 190 degrees Celsius) slightly higher than the R2. If the inequality D<R3 is established, a sheet is fed to the nip N at either the increased interval between sheets of the precedent fixing process or an ordinary interval thereof and the next fixing process is executed. By contrast, if the inequality D≥R3 is established, feeding of sheets and operation of the halogen heater 23 are stopped and the fixing belt 21 is rotated to promote heat radiation from the fixing belt 21. The fixing belt 21 is rotated until the temperature conversion value D sent from the temperature sensor 56 becomes a prescribed reference temperature Rx (e.g., about 170 degrees Celsius) less than the first prescribed temperature R2 by the above-described operation. When the inequality D≤Rx is met, a sheet is fed to a nip N and a fixing process is executed.

Figure 8:
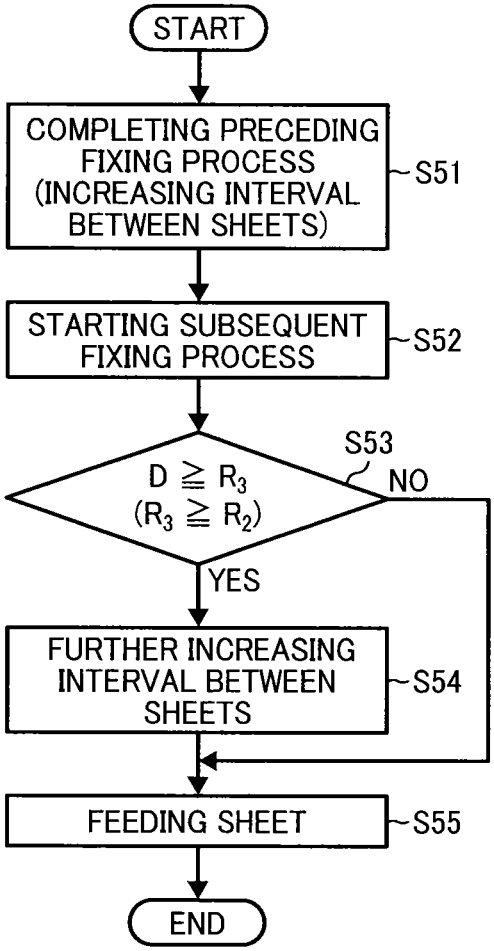
FIG. 8 is a flow chart illustrating yet another embodiment of the present invention.

Now, yet another example of heat dissipation is described with reference to FIG. 8. In the above-described second example of FIG. 7, the fixing belt 21 is rotated until the temperature conversion value D becomes less than the prescribed reference temperature after completing the precedent fixing operation with the increased interval between sheets before the next fixing process. However, instead of rotating the fixing belt 21 to radiate heat, the interval between sheets can be further increased to promote the heat radiation before the next fixing process starts as shown in FIG. 8. Specifically, when determining whether the temperature conversion value D entered into the control unit 54 is less than the second reference temperature R3, the registration roller 12 is controlled to further increase the interval between sheets when the inequality D≥R3 is met as a difference from the example of FIG. 7. The interval between sheets thus increased can be about 30 seconds.

Hence, any one or appropriately combined control manners of the above-described examples are used, temperature of the fixing belt 21 is controlled not to exceed the upper temperature limit (e.g., about 260 degrees Celsius) even when the overshoot occurs in the fixing belt 21 either after passing of a sheet or at a time of sheet jamming. Consequently, machine shut down caused by frequent activation of the overheat safety protection device 50 during normal operation can be substantially prevented. A rotational speed of the fixing belt 21 can be the same as an ordinary printing speed or is slower than that.

Further, in the above-described various examples, as a device for radiating heat from the fixing belt 21, either an interval between sheets is increased or the fixing belt 21 is rotated to provide idling rotation. However, beside that, the heat radiation from the fixing belt 21 can be similarly promoted by decreasing a speed of feeding a sheet P (i.e., a line velocity). However, to reduce the line speed, the image formation section 4 and the transfer device 3 need to correspond to the thus decreasing in the line speed, so that a mechanism and a control manner become complex. Further, the fixing belt 21 can be cooled by a cooling fan, or heat can be dissipated from the fixing belt 21 by a cooling member in contact with either the fixing belt 21 or the pressing roller 22. However, the above-described devices increase a cost or make layout difficult. In views of the cost, design flexibility, and effectiveness, most effective manners of radiating heat from the fixing belt 21 are increasing an interval between sheets and providing idling rotation of the fixing belt 21.

Further, when jamming of a sheet P occurs in the middle of a print job (e.g., sheet feeding), it is appropriately detected by a detector and an image forming apparatus 1 quickly stops. The fixing belt 21 and the pressing roller 22 then stop rotating. Further, the relay 52 is turned off, so that power supply to the halogen heater 23 is stopped. As a recovery from the jamming, a jam occurrence section is drawn from the image forming apparatus 1, a jamming sheet P is removed, and the jam occurrence section is then set again to the image forming apparatus 1. Otherwise, the recovery is executed by pressing a start instruction button for resuming the print job after re-setting the jam occurrence section. However, the fixing belt 21 in a stopped state is heated by remaining heat of the halogen heater 23 from when the image forming apparatus 1 suddenly stops to when an external operation for the recovery from such jamming is executed. Therefore, the fixing belt 21 is likely locally heated near the halogen heater 23, and the fixing belt 21 is heated over the upper limit (about 260 degrees Celsius) during the jam recovery. In such a condition, when the relay 52 is turned on to resume the print job, the overheat safety protection device 50 recognizes the condition as system abnormality thereby causing machine shut down.

Figure 9:
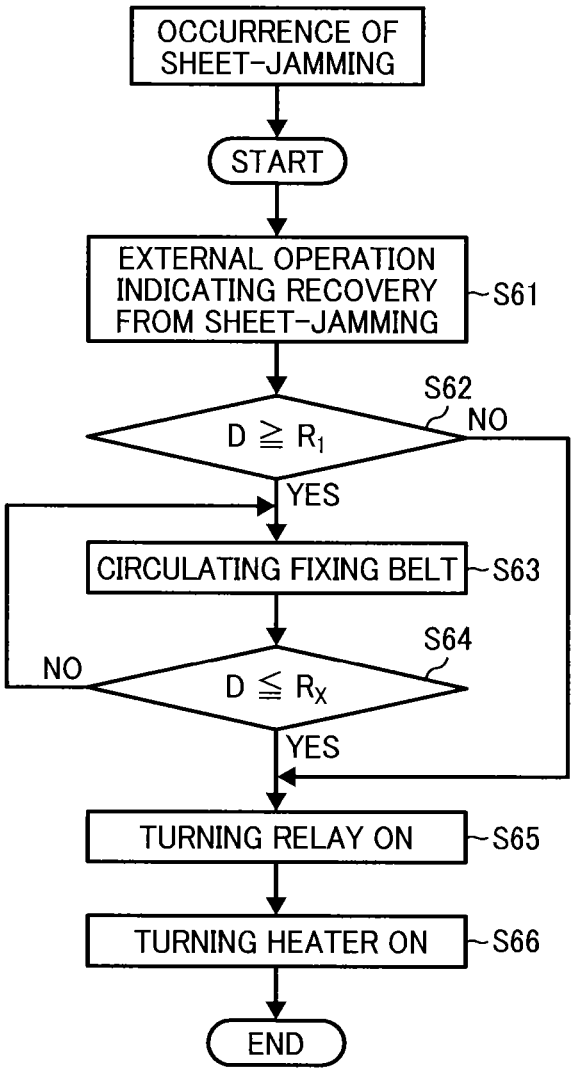
FIG. 9 is a flow chart illustrating yet another embodiment of the present invention.

Such a problem is resolved as shown in the flowchart of FIG. 9. Specifically, when the external operation for the jam recovery is executed and the temperature conversion value D of the temperature sensor 56 is more than the third reference R1 (about 220 degrees Celsius) (i.e., D≥R1) at that time, the fixing belt 21 is preferably rotated to give idling rotation maintaining the relay 52 in a turning off state, and such a condition is desirably maintained until the temperature conversion value D of the temperature sensor 56 becomes less than the reference Rx (e.g., about 170 degrees Celsius), for example. Whereas, when it is determined that the inequality D≤Rx is met, the control unit 54 turns the relay 52 on and allows the electricity to be supplied to the halogen heater 23, and ordinary temperature control program is implemented to resume the print job. Hence, inconvenience of machine shut down caused by activation of the overheat safety prevention device 50 when the recovery from sheet jamming is executed can be avoided. Such control can be similarly executed when the image forming unit 1 restarts, a mode is changed from a turning off mode or an energy saving mode of the fixing device 20 to a printing mode, and a recovery from urgent stop of the image forming unit 1 is executed.

Although the fixing device 20 of FIG. 2 uses a single halogen heater 23 as a heat source, the present invention also includes an fixing device 20 using two or more halogen heaters 23 as the heat source. Such a fixing device 20 with the multiple heaters 23 is frequently installed in the image forming apparatus 1 to print a different size of a sheet.

Figure 12:
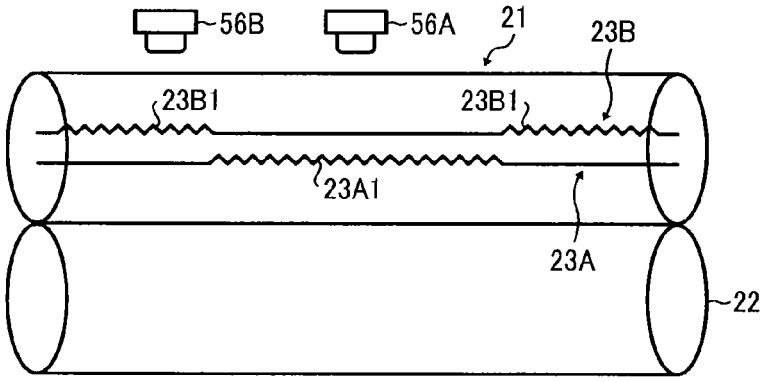
FIG. 12 is a plan view of a fixing device according to another embodiment of the present invention.

Further, FIG. 12 illustrates a fixing device equipped with a pair of halogen heaters 23A and 23B. As shown, when the halogen heaters 23A and 23B of lower and upper sides are regarded as first and second halogen heaters in the drawing, respectively, a heat-generating section of each of the first and second halogen heaters 23A and 23B is located at a different position.

Specifically, the first halogen heater 23A has a heat-generating portion (e.g., a heat emitting portion) 23A1 extending in its longitudinal direction from its center over a given range. More specifically, the heat generation section 23A1 is disposed in the first halogen heater 23A in a range of from about 200 mm to about 220 mm regarding the longitudinal center thereof as a symmetrical axis (center).

Whereas, the second halogen heater 23B has pair of heat-generating portions (e.g., heat emitting portions) at each end in the longitudinal direction. More specifically, the heat generation sections 23B1 are symmetrical disposed on both sides of the second halogen heater 23B each ranging from about 200 mm or 220 mm to about 300 mm or 330 mm regarding the longitudinal center thereof as a symmetrical axis (center). In general, a sheet passing width of an A4 (JIS) sized sheet (i.e., a lateral direction) or an A3 (JIS) sized sheet (i.e., a longitudinal direction) is about 297 mm. Whereas, the total length of the heating section 23A1 located at the center of the first halogen heater 23A and that of the heating section 23B1 located at the both sides of the halogen heater 23B is from about 300 mm to about 330 mm and is longer than the above-described sheet passing width. That is, since a calorie decreases and temperature drops at an outer edge of the heat generation portion 23B1 (i.e., luminous intensity decreases), only the heat generation section 23B1 other than the outer edge generating more than a prescribed calorie (i.e., heat generation strength) is to be used as a detection target.

In such system, multiple temperature sensors 56 are preferably placed at various locations in the longitudinal direction of the fixing belt 21. In FIG. 12, when the temperature sensor 53A on the right side is regarded as a first temperature sensor, and the temperature sensor 56B on the left side is as a second temperature sensor, respectively, the first temperature sensor 56A is disposed to be able to detect temperature of a central region of the fixing belt 21 corresponding to the heat generation section 23A1 of the halogen heater 23A. Whereas, the second temperature sensor 56B is disposed to be able to detect temperature of end side regions of the fixing belt 21 corresponding to the heat generation sections 23B1 of the halogen heater 23B.

Also with such a system, by installing a pair of overheat safety prevention devices 50 each having a pair of temperature sensors 56A and 56B, machine shut down caused by erroneous detection by the overheat safety prevention device 50 can be substantially prevented.

Figure 13:
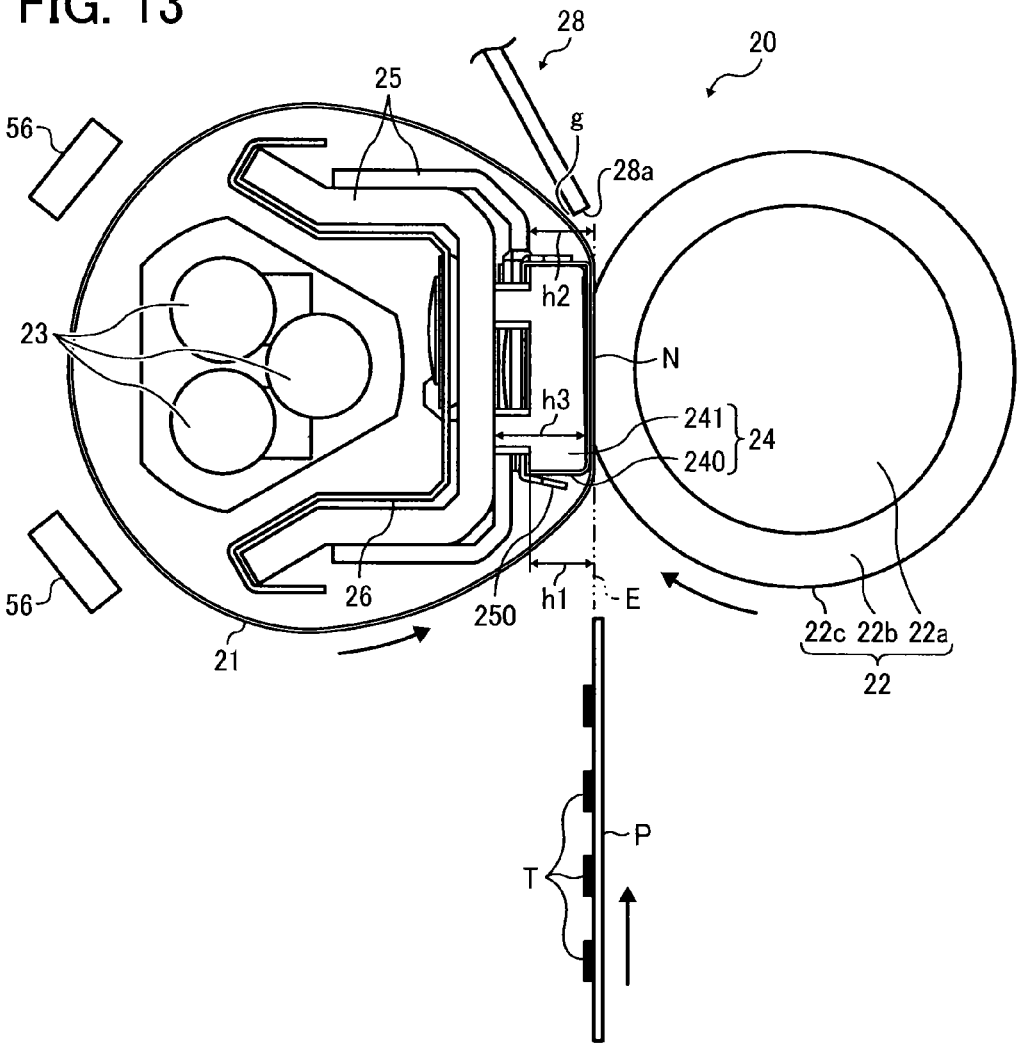
FIG. 13 is a cross-sectional view illustrating a fixing device according to yet another embodiment of the present invention.

A fixing device 20 shown in FIG. 13 has three halogen heaters 23 as a heat source. A metal sheet 250 is provided around most of a nip formation member 24, so that the nip formation member 24 is supported by a stay 25 through the metal sheet 250. Even in the fixing device with such a configuration, by disposing a pair of overheat safety prevention devices 50 each having temperature sensors 56 at plural sections, respectively, machine shut down caused by erroneous detection by the overheat safety prevention device 50 can be substantially prevented. Since a remaining configuration of this embodiment of FIG. 13 is basically the same as that in the embodiment of FIG. 2, duplicative description is omitted here.

The present invention is not limited to the above-described embodiment in which the fixing device has a thin fixing belt with a small diameter to improve energy saving. For example, the image forming apparatus can be equipped with a fixing device employing a belt system in that a fixing belt is stretched around a heating roller and an fixing roller while a pressing roller is pressed against the fixing roller via the fixing belt. Further, the image forming apparatus can be equipped with another fixing device such as a surf fixing device in that only a nip portion is locally heated by a ceramic heater or the like. A interval between sheets, temperature, and an idling rotation time or the like employed in the above-described embodiments are only examples, and can be appropriately modified depending on usage and expected performance of the image forming apparatus 1. Further, the present invention is not limited the fixing device installed in the color laser printer shown in FIG. 1, but can be installed in a black and white image forming apparatus.

Numerous additional modifications and variations of the present invention are possible in light of the above teachings. It is therefore to be understood that within the scope of the appended claims, the present invention may be practiced otherwise than as specifically described herein.

What is claimed is:

1. A fixing device comprising:

a rotatable fixing member to apply heat to a recording medium bearing an unfixed image thereon;

a heat source to heat the fixing member;

a rotatable pressing member to press against the fixing member;

a nip formation member opposed to the pressing member in the fixing member, the nip formation member forming a fixing nip between the fixing member and the pressing member;

a conveyance path to convey the recording medium via the fixing nip;

a sheet ejection member to receive and transport the recording medium ejected from the fixing nip, the sheet ejection member disposed downstream of the fixing nip in the conveyance path; and a controller to stop rotation of the fixing member while the recording medium is being transported by the sheet ejection member through the conveyance path after passing through the fixing nip.

2. The fixing device as claimed in claim 1, wherein the heat source is turned off before the fixing member stops the rotation.

3. The fixing device as claimed in claim 1, further comprising a temperature detector to detect temperature of the fixing member, wherein the fixing member dissipates heat in accordance with a detection value detected by the temperature detector.

4. The fixing device as claimed in claim 1, wherein the controller changes an amount of heat dissipated from the fixing member by changing an interval between continuously fed recording sheets.

5. The fixing device as claimed in claim 1, wherein the heat source comprises a halogen heater.

6. The fixing device as claimed in claim 1, further comprising separate rotary actuators for driving the fixing member and the sheet ejection member, respectively.

7. The fixing device as claimed in claim 3, wherein the controller controls the fixing member to rotate and dissipate the heat while deactivating the heat source.

8. The fixing device as claimed in claim 3, wherein the heat is dissipated from the fixing member when the detection value detected by the temperature detector exceeds a prescribed level.

9. The fixing device as claimed in claim 3, wherein the heat is dissipated from the fixing member when a gradient of the temperature detected by the temperature detector exceeds a prescribed level.

10. The fixing device as claimed in claim 7, wherein the fixing member is rotated until temperature detected by the temperature detector decreases below the prescribed level.

11. The fixing device as claimed in claim 7, wherein the fixing member is rotated for a prescribed time period.

12. An image forming apparatus comprising:

an image formation unit to form a toner image on a recording medium;

a fixing device to fix the toner image on the recording medium, the fixing device including:

a rotatable fixing member to apply heat to the recording medium bearing the toner image thereon;

a heat source to heat the fixing member;

a rotatable pressing member to press against the fixing member; and a nip formation member opposed to the pressing member in the fixing member, the nip formation member forming a fixing nip between the fixing member and the pressing member;

a conveyance path to convey the recording medium via the fixing nip;

a sheet ejection member to receive and transport the recording medium ejected from the fixing nip, the sheet ejection member disposed downstream of the fixing nip in the conveyance path; and a controller to stop rotation of the fixing member while recording medium is transported by the sheet ejection member through the conveyance path after passing through the fixing nip.

13. The image forming apparatus as claimed in claim 12, wherein the heat source is turned off before the fixing member stops rotation.

14. The image forming apparatus as claimed in claim 12, further comprising a temperature detector that detects temperature of the fixing member, wherein the fixing member dissipates heat in accordance with a detection value detected by the temperature detector.

15. The image forming apparatus as claimed in claim 14, wherein the controller controls the fixing member to rotate and dissipate the heat while deactivating the heat source.

16. The image forming apparatus as claimed in claim 14, wherein the heat is dissipated from the fixing member when the detection value detected by the temperature detector exceeds a prescribed level.

17. The image forming apparatus as claimed in claim 14, wherein heat is dissipated from the fixing member when a gradient of the temperature detected by the temperature detector exceeds a prescribed level.

18. The image forming apparatus as claimed in claim 15, wherein the fixing member is rotated for a prescribed time period.

19. The image forming apparatus as claimed in claim 16, wherein the fixing member is rotated until temperature detected by the temperature detector decreases below the prescribed level.

20. A fixing device comprising:

heating means for applying heat to a recording medium bearing an unfixed image thereon;

fixing means for fixing the unfixed image;

pressing means for pressing against the fixing means;

nip forming means for forming a fixing nip between the fixing means and the pressing means, the nip forming means opposed to the pressing means in the fixing means;

means for conveying the recording medium via the fixing nip;

means for transporting the recording medium ejected from the fixing nip, the transporting means disposed downstream of the fixing nip in a conveyance path conveying the recording medium;

means for detecting temperature for detecting temperature, first control means for controlling the fixing means to stop rotation while the recording medium is being transported by the transporting means after passing through the fixing nip and second control means for controlling the heating means to stop operation before the fixing means stops the rotation, wherein the fixing means dissipates heat in accordance with a detection value detected by the temperature detecting means.

21. An image forming apparatus comprising:

an image formation unit to form a toner image on a recording medium;

a fixing device to fix the toner image on the recording medium; and a controller to control the image formation unit and the fixing device, wherein the fixing device comprises:

a rotatable fixing member to apply heat to the recording medium bearing the toner image thereon;

a heat source to heat the fixing member;

a rotatable pressing member to press against the fixing member to form a fixing nip between the fixing member and the pressing member;

a rotation driving source to drive and rotate the fixing member and the pressing member;

a relay to open and close a power supply path connected to the heat source;

a temperature detector connected to the relay and the controller, to detect a temperature of the fixing member, and a high temperature circuit to turn off the relay to cut off power supply to the heat source when the temperature of the fixing member detected by the temperature detector exceeds an upper temperature limit wherein the controller causes the fixing member to dissipate heat when the temperature detected by the temperature detector is more than a prescribed level and is smaller than the upper temperature limit.

22. The image forming apparatus according to claim 21, wherein the controller controls the rotation driving source and the heat source, and wherein the controller stops the heat source and causes the rotation driving source to rotate the fixing member so as to cause the fixing member to dissipate heat.

23. The image forming apparatus according to claim 22, wherein the controller controls the rotation driving source to resume rotation of the fixing member so as to cause the fixing member to dissipate heat.

24. The image forming apparatus according to claim 22, wherein the controller controls the rotation driving source to rotate the fixing member for a prescribed time period.

25. The image forming apparatus according to claim 22, wherein the controller controls the rotation driving source to rotate the fixing member until the temperature detected by the temperature detector is below a prescribed level.

26. The image forming apparatus according to claim 21, wherein the controller changes an interval between recording media continuously fed to the fixing nip, and wherein the controller increases the interval to cause the fixing member to dissipate heat.

27. The image forming apparatus according to claim 21, wherein the high temperature circuit turns off the relay when the temperature detected by the temperature detector reaches a prescribed upper limit.

28. The image forming apparatus according to claim 27, wherein the high temperature circuit turns off the relay without converting a detection signal of the temperature detector into temperature.

* * * * *